US009409688B2

(12) United States Patent
Kelly et al.

(10) Patent No.: US 9,409,688 B2
(45) Date of Patent: Aug. 9, 2016

(54) TRAY SYSTEM FOR DISPLAY, STORAGE AND TRANSPORTATION OF BOTTLES

(71) Applicant: Polymer Solutions International, Inc., Medford, NJ (US)

(72) Inventors: Daniel E. Kelly, Medford, NJ (US); John A. Spadavecchia, Red House, VA (US); James A. Favaron, Columbia, SC (US); Jeff Jacobs, Lugoff, SC (US)

(73) Assignee: Polymer Solutions International, Inc., Medford, NJ (US)

( * ) Notice: Subject to any disclaimer, the term of this patent is extended or adjusted under 35 U.S.C. 154(b) by 0 days.

(21) Appl. No.: 14/658,681

(22) Filed: Mar. 16, 2015

(65) Prior Publication Data

US 2015/0183552 A1 Jul. 2, 2015

Related U.S. Application Data

(63) Continuation-in-part of application No. 14/375,184, filed as application No. PCT/US2013/023742 on Jan. 30, 2013.

(60) Provisional application No. 61/592,098, filed on Jan. 30, 2012.

(51) Int. Cl.
*B65D 71/70* (2006.01)
*B65D 1/24* (2006.01)

(52) U.S. Cl.
CPC ..... *B65D 71/70* (2013.01); *B65D 1/243* (2013.01); *B65D 2501/24019* (2013.01); *B65D 2501/24267* (2013.01)

(58) Field of Classification Search
CPC ..... B65D 71/70; B65D 81/02; B65D 81/05; B65D 81/127; B65D 81/133; B65D 2571/00814; B65D 21/0231; B65D 21/0212; B65D 1/243; B65D 2501/24267; B65D 2501/24286
USPC ..... 220/509, 514, 515, 519; 206/433, 521, 206/523, 585, 587, 588, 514, 821, 509, 511
See application file for complete search history.

(56) References Cited

U.S. PATENT DOCUMENTS 4,360,231 A 11/1982 Bolin
4,593,818 A * 6/1986 Schenkman ..... B65D 21/0224 206/503

(Continued)

FOREIGN PATENT DOCUMENTS

DE 8700993 4/1987
DE 433 7510 A1 5/1995

(Continued)

OTHER PUBLICATIONS

Entire patent prosecution history of U.S. Appl. No. 14/375,197, filed, Jul. 29, 2014, entitled, "Pallet System for Display, Storage and Transportation of Bottles."

(Continued)

*Primary Examiner* — Fenn Matthew
*Assistant Examiner* — Robert Stodola
(74) *Attorney, Agent, or Firm* — RatnerPrestia

(57) ABSTRACT

A tray system for display, storage and transportation of bottles includes a first tray having a plurality of stacking units. Each stacking unit can include a lower receptacle for receiving a neck portion of a first bottle. Each stacking unit can also include an upper receptacle for receiving a base portion of a second bottle to be stacked vertically above a first bottle. The lower receptacle can include a first end, a second end opposite the first end, and a sidewall connecting the first end with the second end. The first end forms an opening for receiving a neck of the first bottle into the lower receptacle. The lower receptacle further includes a protective element. The protective element can be attached to the lower receptacle to provide a protective guard between the lower receptacle and a shoulder portion of the first bottle received in the lower receptacle.

21 Claims, 15 Drawing Sheets

(56) References Cited

U.S. PATENT DOCUMENTS

| | | | | |
|---|---|---|---|---|
| 4,846,365 | A | 7/1989 | Steinlein | |
| 5,016,761 | A | 5/1991 | Stoddard | |
| 5,038,961 | A * | 8/1991 | Watanabe | B65D 71/70 206/203 |
| 5,178,276 | A | 1/1993 | Sheets | |
| 5,263,605 | A | 11/1993 | Caton | |
| 5,360,112 | A | 11/1994 | Beauchamp | |
| 5,377,862 | A | 1/1995 | Oakes | |
| 5,651,459 | A * | 7/1997 | Umiker | B65D 71/70 206/203 |
| 5,769,230 | A | 6/1998 | Koefelda | |
| 5,857,416 | A | 1/1999 | Donnell, Jr. | |
| 6,279,770 | B1 | 8/2001 | Osbakk | |
| 7,124,890 | B2 | 10/2006 | McLeod | |
| 2008/0196633 | A1 | 8/2008 | Ho | |
| 2009/0057248 | A1 | 3/2009 | Vishnevsky | |
| 2009/0301926 | A1 | 12/2009 | Ogburn | |
| 2011/0284411 | A1 | 11/2011 | Delbrouck | |

FOREIGN PATENT DOCUMENTS

| | | | |
|---|---|---|---|
| DE | 20 2004 007452 | U1 | 10/2004 |
| EP | 0 306 074 | A1 | 3/1989 |
| EP | 1652784 | | 5/2006 |
| GB | 2220196 | | 1/1990 |
| GB | 2 240 326 | A | 7/1991 |
| GB | 2 335 414 | A | 9/1999 |
| GB | 2 451 425 | A | 2/2009 |
| WO | WO 99/15427 | | 4/1999 |
| WO | 2004014754 | | 2/2004 |

OTHER PUBLICATIONS

International Search Report and Written Opinion issued in related International Application No. PCT/US2013/023746, dated May 24, 2013.

Office Action mailed Jul. 28, 2015 in U.S. Appl. No. 14/375,197.

English Translation for DE 202004007452.

English Translation for DE 4337510.

Entire patent prosecution history of U.S. Appl. No. 14/375,184, filed, Jul. 29, 2014, entitled, "Tray System for Display, Storage and Transportation of Bottles."

International Search Report and Written Opinion issued in related International Application No. PCT/US2013/023742, dated May 23, 2013.

International Preliminary Report on Patentability issued in related International Application No. PCT/US2013/023742, dated Aug. 5, 2014.

Office Action mailed Oct. 1, 2015 in U.S. Appl. No. 14/375,184.

Office Action mailed Oct. 8, 2015 in U.S. Appl. No. 14/375,197.

EPO Communication dated Nov. 16, 2015 in related EP Application No. 13 706 329.3.

Notice of Allowance mailed Dec. 8, 2015 in U.S. Appl. No. 14/375,197.

Non Final Office Action mailed Apr. 22, 2016 for U.S. Appl. No. 14/375,184.

International Search Report and Written Opinion of the International Searching Authority for International Application No. PCT/US2016/021497, dated May 19, 2016.

* cited by examiner

TRAY SYSTEM FOR DISPLAY, STORAGE AND TRANSPORTATION OF BOTTLES

RELATED APPLICATIONS

This application is a continuation-in-part of, and claims the benefit of priority of, U.S. application Ser. No. 14/375,184, filed Jul. 29, 2014, which is the U.S. National Phase of International Application No. PCT/US2013/023742, filed Jan. 30, 2013, which in turn claims the benefit of priority of U.S. Application No. 61/592,098, filed Jan. 30, 2012. The contents of the foregoing applications are incorporated by reference herein in their entirety for all purposes.

FIELD

The present disclosure relates generally to apparatuses for storing and transporting containers, and more specifically to a tray system used for displaying, storing and transporting product containers in vertically stacked arrangements.

BACKGROUND

Businesses engaged in the home-office-delivery (HOD) bottled water business face a number of challenges in delivering bottled water to customers. Bottled water businesses also face a number of challenges in retrieving empty bottles from customers, and transporting the empty bottles back to a facility for cleaning and refilling. The size, shape and weight of these bottles make them very prone to tipping over and rolling during transport to and from the customer. If the bottles are allowed to tip over and roll, the bottles can be damaged, resulting not only in spillage of water, but also in the loss of the container.

Bottled water businesses often ship bottled water to customers in bulk. The bottles are frequently shipped on wooden pallets. After bottles are placed on top of a wooden pallet, the bottles are secured against shifting by securing straps around the bottles, or by wrapping a plastic film around the pallet and bottles. For large shipments, bottles may be stacked on top of one another. A first level of bottles is placed on a pallet, and a thin sheet of plywood or other material, sometimes called a "slip sheet", is placed on top of the first level of bottles. A second level of bottles is then placed on the slip sheet. A second slip sheet may be placed on the second level of bottles to support a third level of bottles. The multi-level stack of bottles is then secured with straps or plastic film to secure the bottles together.

There are several drawbacks to using traditional pallets and slip sheets. A major drawback is the need for straps, plastic film or other means for securing the bottles together on the pallet, or between the pallet and slip sheet. This adds time and cost to the process of transporting bottles. When empty bottles are retrieved from customers, they often must be stacked in an orderly arrangement on pallets inside a truck to maximize the number of bottles that can fit inside the truck. Empty bottles are extremely light and very prone to shifting during shipping unless they are secured with plastic wrap or other securing means.

Another drawback of traditional pallets and slip sheets is instability. Even when the bottles, pallets and slip sheets are secured in plastic wrap or other securing means, the stack of bottles can still be unstable because the bottles are seldom centered over one another, allowing the stack to lean to one side.

Traditional pallets and slip sheets also pose problems when using machinery in an automated process to stack bottles.

Pallets and slip sheets have flat surfaces that do not provide target areas on which to place bottles. As such, it is very difficult to load bottles onto a pallet or slip sheet in an automated process, and particularly difficult to stack bottles so that they are centered over one another in a stable arrangement.

Yet another drawback of traditional pallets and slip sheets is the stress they place on bottles. When bottles are stacked on top of one another on pallets and slip sheets, an enormous amount of load is placed on the spout and cap of each bottle, particularly the spouts and caps of bottles on the bottom level. This leads to frequent breakage of the caps during loading and shipment, resulting in loss of product.

Lastly, conventional wood pallets and slip sheets are not suitable for displaying bottles to customers in stores. Wood pallets frequently exhibit broken planks, popped nails, splintered surfaces and other features that can detract from the store display.

SUMMARY

The drawbacks of conventional systems for bottle display, storage and transportation are resolved by tray systems in accordance with the invention.

A tray system according to one embodiment includes a first tray having a plurality of stacking units. Each stacking unit may form a lower receptacle for receiving a neck portion of a first bottle, and an upper receptacle for receiving a base portion of a second bottle to be stacked vertically above a first bottle. The upper receptacle may include a central longitudinal axis and the lower receptacle may include a central longitudinal axis aligned coaxially with the central longitudinal axis of the upper receptacle.

The upper receptacle may include a bottom wall and a sidewall extending along at least a portion of the bottom wall. The lower receptacle may include a first end, a second end opposite the first end, and a sidewall connecting the first end with the second end. The first end may form an opening for receiving a neck of a second bottle into the lower receptacle. The sidewall of the lower receptacle may surround or partially surround an interior space. The cross sectional area of the interior space at the first end of the lower receptacle may be greater than the cross sectional area of the interior space at the second end.

The sidewall of the lower receptacle may form a frusto-conical-shaped enclosure adapted to surround at least a portion of and protect a neck portion of a second bottle received in the lower receptacle. The first end of the lower receptacle may include a rim that surrounds at least a portion of the opening. The rim may be configured to surround at least a portion of a neck portion of a second bottle received in the lower receptacle. The rim may be further configured to rest on top of a shoulder portion of a second bottle received in the lower receptacle to distribute load onto a shoulder portion of the second bottle received in the lower receptacle. The rim may include a cushion or scratch prevention material, configured to rest directly on a shoulder portion of the second bottle received in the lower receptacle. The cushion or scratch prevention material may include or be formed of a gasket made of elastomeric material.

The plurality of stacking units may be arranged in two or more rows extending in a first direction, and two or more columns extending in a second direction perpendicular to the first direction. The rows may each contain the same number of stacking units, and the columns may each contain the same number of stacking units. The stacking units may be integrally attached to one another in a single homogenous body of unitary construction. Alternatively, the stacking units may be modularly connected to one another.

The sidewall of the lower receptacle may form a neck brace for supporting the first tray on the shoulder portion of a first bottle. The neck brace may include a rim surrounding at least a portion of the opening at the first end and a plurality of posts extending between the rim and the second end. Alternatively, the neck brace may include a solid ring-shaped sidewall with a flattened section and an aperture through the flattened section.

The tray system may include a second tray having a plurality of receiving units for receiving either a base portion of a third bottle or a neck portion of a third bottle. The tray system may also include a pallet for supporting the first and second trays. The second tray may be anchored to the pallet to form a pallet-tray unit.

In another embodiment, a tray system for display, storage and transportation of bottles includes a first tray having a plurality of stacking units, each stacking unit comprising a lower receptacle for receiving a neck portion of a first bottle, each stacking unit further comprising an upper receptacle for receiving a base portion of a second bottle to be stacked vertically above a first bottle, the lower receptacle comprising a first end, a second end opposite the first end, and a sidewall connecting the first end with the second end, the first end forming an opening for receiving a neck of a second bottle into the lower receptacle, the lower receptacle further comprising a protective element, the protective element attached to the lower receptacle to provide a protective guard between the lower receptacle and a shoulder portion of a first bottle received in the lower receptacle.

The first end of the lower receptacle can include a rim that surrounds at least a portion of the opening. The rim can be configured to surround at least a portion of a neck portion of a first bottle received in the lower receptacle. In addition, the rim can be configured to rest on top of a shoulder portion of the first bottle received in the lower receptacle to distribute load onto the shoulder portion of the first bottle received in the lower receptacle.

The protective element can be coupled to the rim and configured to rest directly on a shoulder portion of a first bottle received in the lower receptacle, the protective element thereby being in between the rim and said shoulder portion.

The protective element can consist of or include a cushion element. The cushion element can include a layer of elastomeric material. The protective element can be detachably coupled to the lower receptacle.

The tray system can also include an alternate protective element. The alternate protective element can be interchangeable with the protective element to replace the protective element in the lower receptacle. The protective element can include or consist of a first fitting having a geometry that conforms to a shape and size of a first bottle, and the alternate protective element can include or consist of a second fitting having a geometry that conforms to a shape and size of a second bottle having a different shape and size than said first bottle.

The protective element can include a body portion and a cushion element attached to the body portion. The body portion can include a first section detachably coupled to the lower receptacle and a second section. The first section can include a connecting element for attachment to an interior portion of the lower receptacle. The connecting element can include a plurality of flexible projections arranged around the perimeter of the first section. The interior portion of the lower receptacle can include an interior ledge that abuts the plurality of flexible projections to prevent the protective element from reversing out of the lower receptacle. The lower receptacle can also include a bearing surface that abuts the second section of the body portion.

The protective element can be rotatably coupled to the lower receptacle to provide a dynamic element that rotates or spins in unison with a first bottle received in the lower receptacle. The protective element can include a floating cushion in the lower receptacle. The protective element can also include one or more extensions that contact a first bottle received in the lower receptacle to limit an amount of surface area on the protective element that contacts said first bottle. The one or more extensions can include a plurality of ribs spaced around the protective element.

The protective element can include a first section that is generally cylindrical and a second section that comprises a bell shape.

The tray system can further include a second tray configured identically to the first tray and stackable above or below the first tray.

DETAILED DESCRIPTION

Although this description makes reference to specific embodiments, the invention is not intended to be limited to the details shown. Rather, various modifications may be made in the details within the scope and range of equivalents of the claims and without departing from the invention.

The foregoing drawbacks of wood pallets and slip sheets are addressed to a large extent by tray systems in accordance with the invention, examples of which are described in this disclosure.

Figure 1:
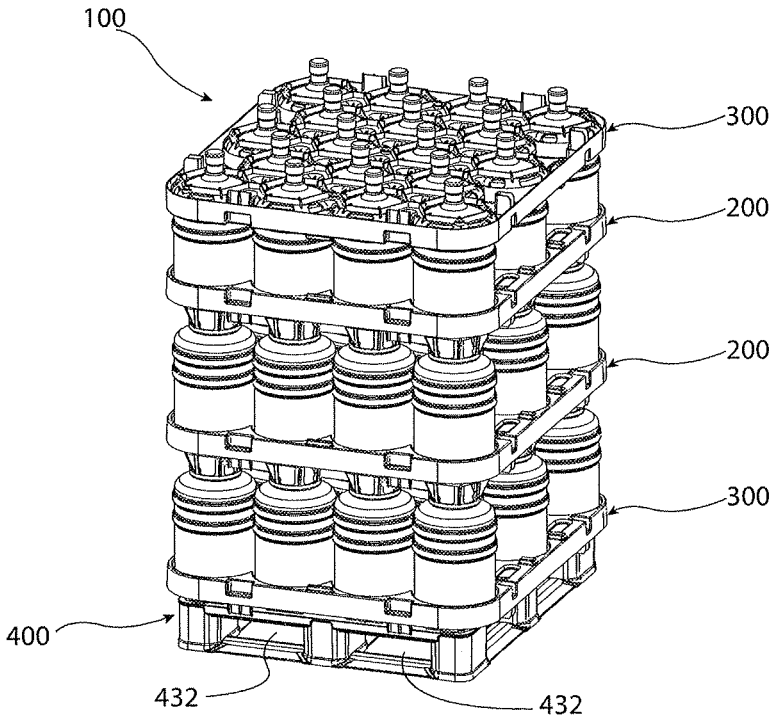
FIG. 1 is a perspective view of a tray system for the display, bulk storage and transportation of bottles in accordance with one exemplary embodiment, shown loaded with bottles.

Tray systems in accordance with the invention may be manufactured by injection molding, thermoforming, rotational molding or other manufacturing processes. FIG. 1 shows a tray system 100 in accordance with one embodiment that is manufactured by injection molding. For purposes of this description, tray system 100 is shown and described as it would be used for displaying, storing and transporting five gallon water bottles in bulk. Those skilled in the art will understand that tray systems in accordance with the invention, such as tray system 100, can be used for displaying, storing and transporting a variety of containers and contents, and are not necessarily designed exclusively for water bottles, or containers having a specific size, volume or shape. For example, tray systems in accordance with the invention can be used to display, store and transport propane tanks and other cylindrical or non-cylindrical containers and packages.

Tray systems in accordance with the invention may be used to display bottles in stores, showrooms and other areas in which contained product is placed on display. Tray systems in accordance with the invention may also be used to store and transport bottles in stacks having two or more levels of bottles. In describing tray systems, reference will be made to one or more "first bottles", one or more "second bottles", one or more "third bottles", and so forth. The term "first bottle", as used herein, means a bottle in the bottom level in a stack. No bottles are stacked below a first bottle. The term "second bottle", as used herein, means a bottle in a level immediately above the level containing a first bottle. The term "third bottle", as used herein, means a bottle in a level immediately above the level containing a second bottle.

Figure 3:
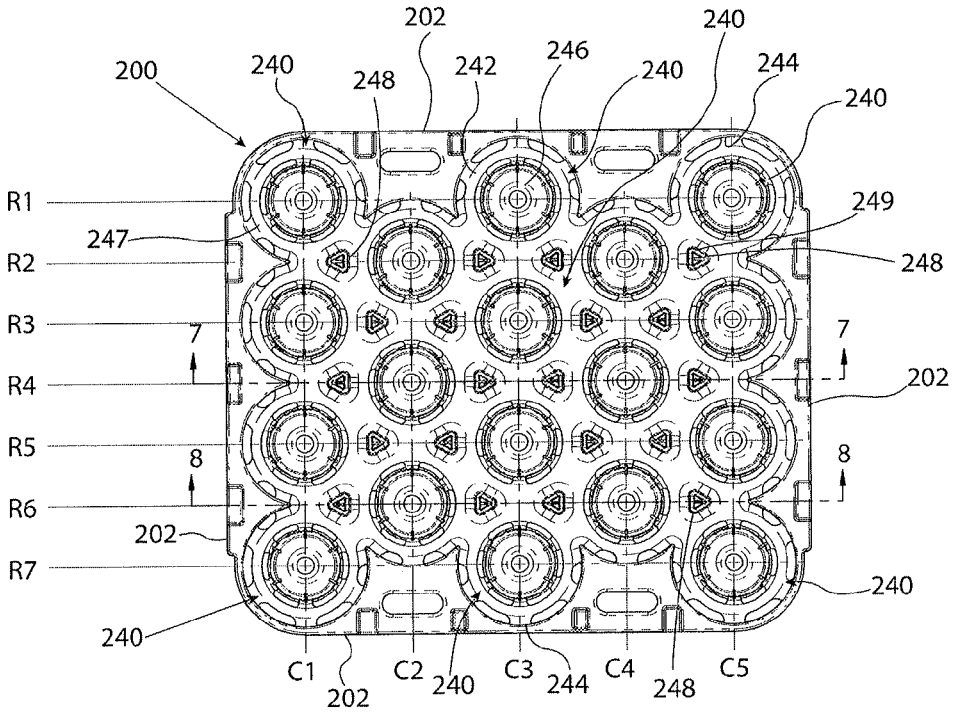
FIG. 3 is a top view of a first tray component of the tray system in FIG. 1.

The drawing figures contain a number of features that are shown multiple times in the same figure. For example, FIG. 3 shows a plurality of "upper receptacles" some of which are identified with the label "240". When a feature is shown multiple times in the same drawing figure, the drawing figure may contain a label for only some of the features that are shown. This is done solely to avoid using an excessive number of labels in the same drawing, which could create clutter and obscure other features in the drawings.

Tray system 100 includes two types of trays: a first tray or "shoulder tray" 200, and a second tray or "top/bottom tray" 300. Shoulder trays 200 and top/bottom trays 300 provide a visually attractive and aesthetically pleasing display apparatus for displaying vertical stacks of bottles. Shoulder trays 200 and top/bottom trays 300 also provide a sturdy and secure system for storing and transporting bottles without the need for straps, plastic wrap or other means for securing the bottles.

Figure 2:
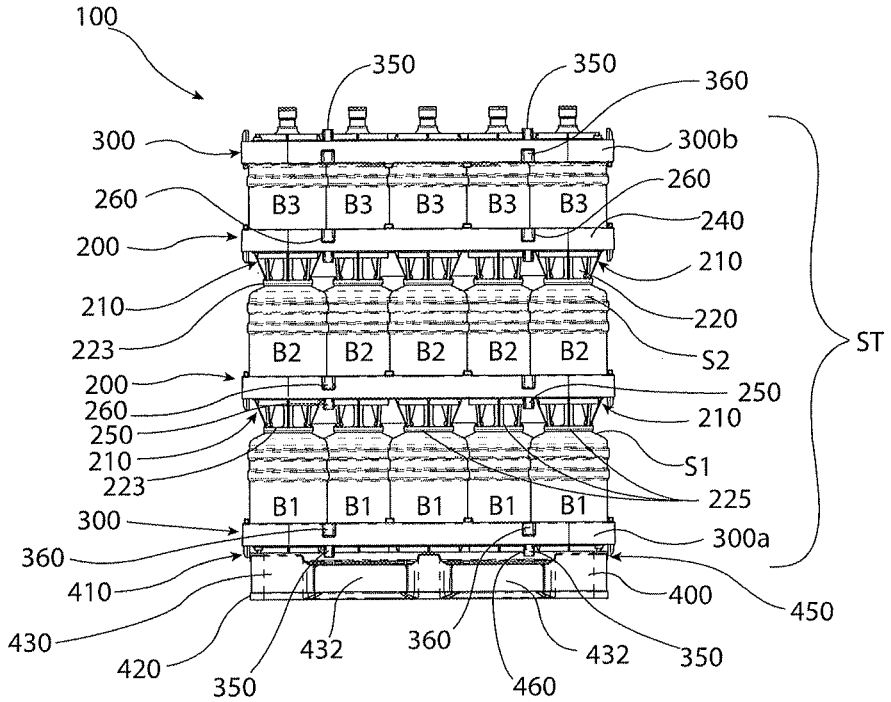
FIG. 2 is a front view of the tray system and bottles in FIG. 1.

Each shoulder tray 200 is made up of a plurality of stacking units 210. Each stacking unit 210 forms a lower receptacle 220 for receiving a neck portion of a bottle. Each stacking unit 210 also forms an upper receptacle 240 for receiving a base portion of a bottle. The stacking units allow stacking of a second bottle in an upright position, directly above a first bottle that is also in an upright position. The term "upright", as used herein in describing a bottle, means that the bottle is oriented with its neck and spout vertically positioned above the rest of the bottle. FIGS. 1 and 2 illustrate stacking arrangements with third bottles B3 stacked vertically above second bottles B2, and second bottles B2 stacked vertically above first bottles B1, all bottles oriented in upright positions.

FIGS. 3-9 illustrate the lower receptacles 220 and upper receptacles 240 on each shoulder tray 200 in more detail. Each upper receptacle 240 includes a bottom wall 242 and a sidewall 244 surrounding the bottom wall. Bottom wall 242 and sidewall 244 form a socket 246 for receiving the base portion of a bottle. Sockets 246 provide specific landing locations in the tray that can be recognized and targeted by robotic loading equipment to facilitate the loading of empty bottles into the tray using an automated process. These landing locations provide a specific point of reference on the shoulder tray for each bottle so that the robotic loading equipment can precisely place each bottle on the shoulder tray without interference with another bottle. The landing locations also provide a secure place to set empty bottles in a stable and upright position. In particular, the sidewall 244 and sockets 246 support and hold the base of each bottle, minimizing or preventing the bottles from being knocked over by other bottles as the other bottles are loaded onto the pallet. Conventional wood pallets, in contrast, have no sidewalls or sockets to create landing locations. Therefore, it is extremely difficult for automated machinery to load empty bottles onto conventional wood pallets and keep the bottles on the pallets, because the bottles are free to move and slide on the pallets. Given their extremely light weight, empty bottles can be easily knocked over or pushed off of a conventional wood pallet by other bottles being placed on the pallet. The light weight of empty bottles also makes them very prone to shifting during transport on conventional wood pallets. Therefore, conventional wood pallets that are loaded with empty bottles are typically wrapped in a plastic wrap to hold the bottles in place and prevent them from moving during transport. Shoulder trays with sidewalls and/or sockets in accordance with the invention address all of these challenges by securely holding the bottles in specific landing locations, making loading and transport of empty bottles much easier.

Sockets 246 are arranged adjacently or tangentially to one another, as seen best in FIG. 3. This arrangement allows multiple bottles to be positioned adjacent to one another in a compact arrangement so as to reduce the overall size of shoulder tray 200 and increase the number of bottles that can fit in a tray of a specific size. Sockets 246 that are located along the perimeter or exterior 202 of shoulder tray 200 have sidewalls 244 with a continuous sidewall region 247. Each continuous sidewall region 247 surrounds at least half of its respective socket 246.

Shoulder trays in accordance with the invention may or may not include dividers in the form of walls or posts that border sockets located toward the center or interior of the tray.

Dividers may be desirable to physically separate the sockets from one another and provide defined loading areas on the tray. For example, the sockets 246 that are located toward the center or interior of shoulder tray 200 have sidewalls 244 made up of four or more triangular posts or dividers 248. In preferred embodiments, like the one shown, the triangular dividers 248 each have a concave contour 249 on each side that conforms to the curvature of the bottles to be loaded into the tray. Sockets 246 are preferably dimensioned and arranged to allow a minimum clearance space between bottles so that the bottles can be loaded and unloaded without rubbing against adjacent bottles in the tray.

Those skilled in the art will understand that trays in accordance with the invention need not have dividers between the sockets. In fact, it is sometimes desirable to have no dividers between the sockets to allow the bottles to slide across the bottom of the tray. Freedom to slide on the bottom of the tray sometimes improves access to the bottles and makes bottle loading and unloading easier.

Figure 4:
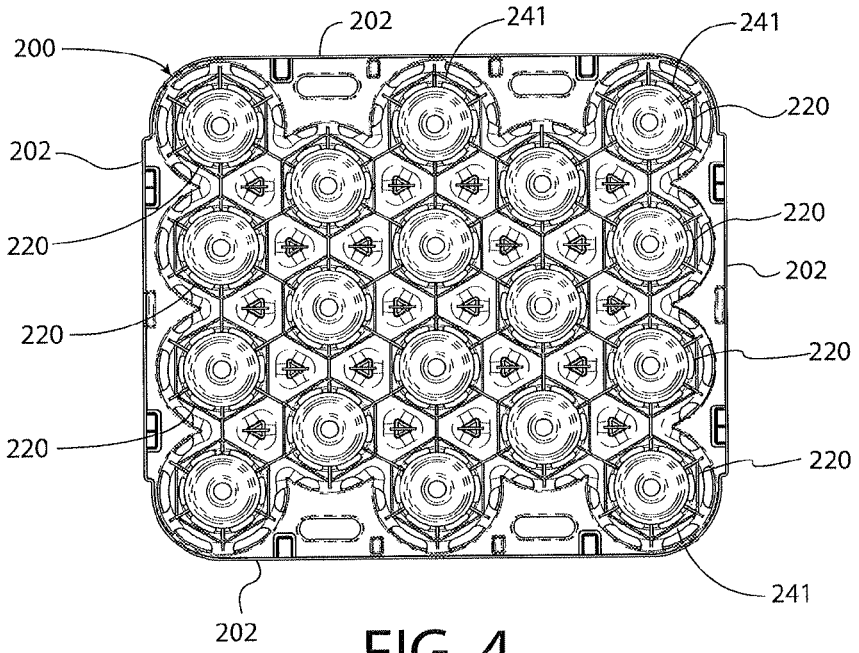
FIG. 4 is a bottom view of the first tray component of FIG. 3.
Figure 5:
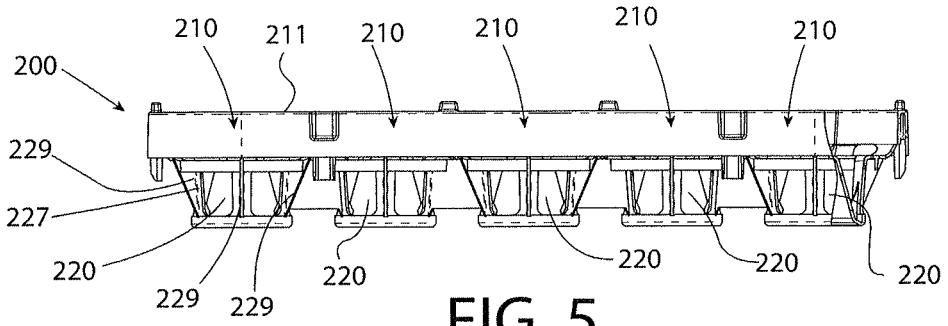
FIG. 5 is a front view of the first tray component of FIG. 3.
Figure 6:
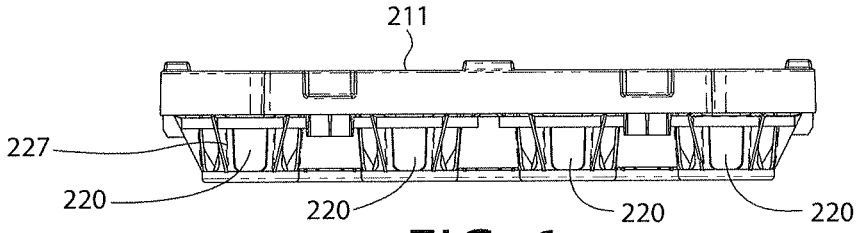
FIG. 6 is a side view of the first tray component of FIG. 3.
Figure 7:
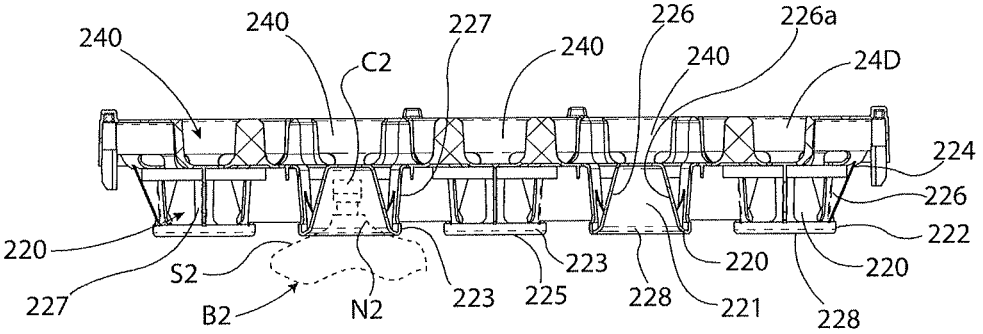
FIG. 7 is a cross-section view of the first tray component of FIG. 3, taken through line 7-7 in FIG. 3, with an outline of a bottle as it could be positioned in the first tray component.
Figure 8:
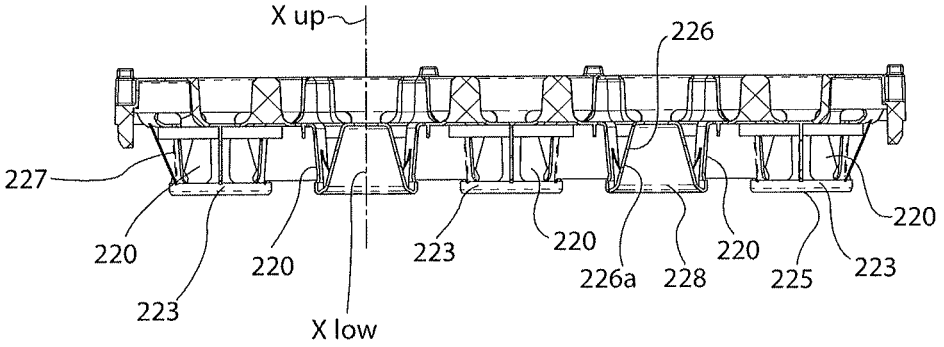
FIG. 8 is a cross-section view of the first tray component of FIG. 3, taken through line 8-8 in FIG. 3.
Figure 9:
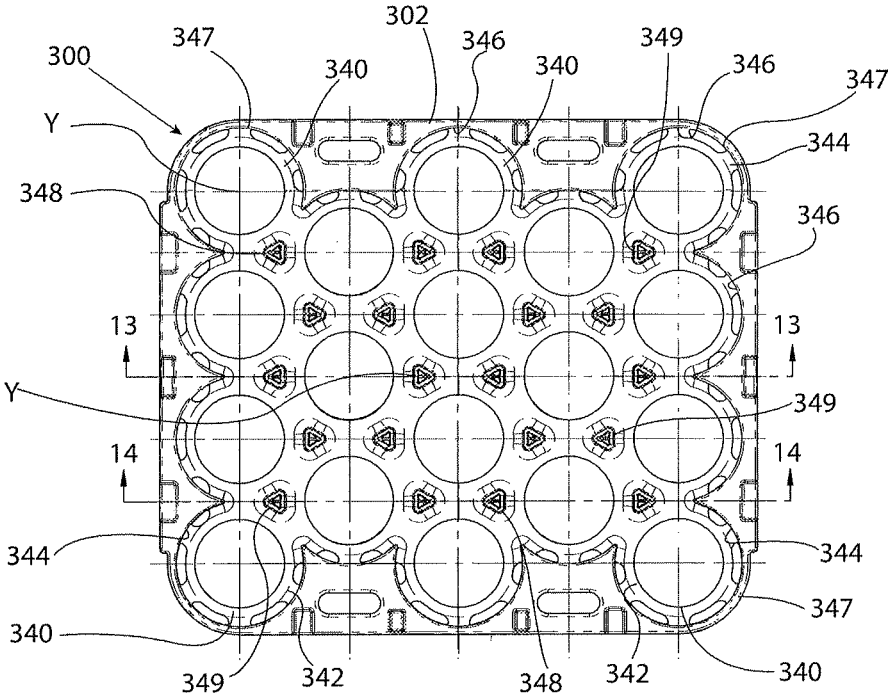
FIG. 9 is a top view of a second tray component of the tray system in FIG. 1.

Referring now to FIGS. 4, 7 and 8, the bottom of each shoulder tray 200 includes a plurality of lower receptacles 220. Each lower receptacle 220 includes a first end 222, a second end 224 opposite the first end, and a sidewall 226 connecting the first end with the second end. Each lower receptacle 220 also has a generally circular geometry at its first end 222, and a generally hexagonal geometry (outlined by hexagons 241) at its second end 224. Sidewall 226 surrounds an interior space 221. First end 222 forms an opening 228 into interior space 221 for receiving the neck of a bottle into lower receptacle 220. FIG. 7 shows the outline of a second bottle B2 with a neck portion N2 extending into the lower receptacle 220. The cross sectional area of interior space 221 at first end 222 is greater than the cross sectional area of the interior space at second end 224. An inner surface 226*a* of sidewall 226 gradually tapers radially inwardly as the sidewall extends from first end 222 to second end 224.

First end includes a generally circular rim 223 that circumscribes opening 228. Rim 223 is configured to surround a neck portion of a bottle that is received in the lower receptacle 220 and rests on a shoulder portion of the bottle. In FIG. 7, rim 223 rests on top of a shoulder portion S2 of second bottle B2 received in the lower receptacle. By resting on shoulder portion S2, rim 223 distributes load onto the shoulder portion of second bottle B2, away from the neck portion N2 and cap C2 on the bottle.

The sidewall 226 of each lower receptacle 220 forms a frustoconical-shaped enclosure or cage adapted to surround and protect the neck portion of a bottle received in the lower receptacle. Sidewall 226 provides a circular neck brace 227 for supporting the tray on the shoulder portion of a bottle beneath the tray. Neck brace 227 includes the rim 223, which completely surrounds the opening at the first end 222, and a plurality of posts 229 extending between the rim and second end 224.

Lower receptacles and neck braces in accordance with the invention may have a number of configurations for protecting the neck of a bottle, and need not have a plurality of posts and a rim that completely surrounds an opening. For example, neck braces in accordance with the invention could include a plurality of wall sections arranged along the outline of a cylinder, a frustum of a cone, or other tubular construct, with gaps separating the wall sections from one another. The tubular construct need not be circular, but may be elliptical, polygonal, or have some other type of geometry for surrounding at least a portion of a bottle neck. Lower receptacles in accordance with the invention can include a plurality of posts interconnected by a rim, where the rim is made up of a plurality of sections arranged along the outline of a circle, oval, ellipse, polygon or other two-dimensional or three-dimensional shape for engaging the shoulder of a bottle. Other configurations for the lower receptacle and neck brace will become apparent from embodiments described in subsequent paragraphs.

The inwardly tapered surface 226*a* of sidewall 226 protects the cap and neck portion from "racking". Racking is a condition that occurs when the neck portion and cap become jammed inside a tray above the bottle. Racking can occur when the tray is tilted during placement onto the bottle, or lifting off of the bottle. The tapered sidewall creates a widened opening with more clearance to allow the shoulder tray to be more easily lowered onto or lifted off of the bottle, with minimal contact or interference with the bottle neck.

Referring to FIG. 8, each lower receptacle 220 has a central longitudinal axis $X_{low}$, and each upper receptacle 240 has a central longitudinal axis $X_{up}$. Central longitudinal axis $X_{up}$ is aligned coaxially with central longitudinal axis $X_{low}$.

Rims in accordance with the invention distribute the weight of bottles stacked above them onto bottles arranged below them. In FIG. 2, for example, the rims 223 that rest on the shoulder portions S2 of the second bottles B2 distribute the weight of third bottles B3. The rims 223 that rest on the shoulder portions S1 of first bottles B1 distribute the weight of the second bottles B2 and third bottles B3. The weight that is distributed to the shoulder portions can be significant. Therefore, the rims may include one or more cushions or other scratch prevention materials that prevent the rims from marring the shoulder portions of underlying bottles when the trays are loaded. For example, FIGS. 2, 7 and 8 show rims 223 with cushions in the form of gaskets 225 that surround the rims. Gaskets 225 (only some of which are labeled in the drawings) are shown resting on the shoulder portions S1 and S2 of bottles B1 and B2, respectively, to protect the surfaces of the bottles. Gaskets that are used in accordance with the invention may have a variety of shapes, thicknesses and material compositions. For example, a gasket formed of a soft elastomeric material, such as Santoprene™ brand thermoplastic vulcanizate, can be used. A gasket can be attached to each rim using an adhesive or other bonding technique.

Shoulder tray 200 includes a total of eighteen lower receptacles 220. This provides a lower receptacle 220 for every bottle loaded beneath a shoulder tray 220, assuming that all bottle spaces are loaded with a bottle. As such, the weight in shoulder tray 220 can be distributed to all of the bottles that are loaded beneath the shoulder tray. Shoulder trays in accordance with the invention need not be provided with a lower receptacle 220 for every bottle loaded beneath the tray, however. That is, lower receptacles need not be provided beneath every socket. For example, a shoulder tray in accordance with the invention may only have lower receptacles beneath sockets along the perimeter of the tray, and not have receptacles beneath sockets toward the center or interior of the tray. Alternatively, lower receptacles may only be provided beneath sockets toward the center or interior of the tray, and not be provided beneath sockets along the perimeter of the tray. Either option is easily visualized by omitting some of the lower receptacles shown in the drawing figures.

Referring now to FIGS. 9-14, the second tray, or "top/bottom tray" 300, is shown in more detail. Top/bottom tray 300 is similar in some respects to shoulder tray 200. A major difference between shoulder tray 200 and top/bottom tray 300 is that the top/bottom tray does not have a lower receptacle with a protective neck brace. Top/bottom tray 300 includes a plurality of receptacles 340. Each receptacle 340 has an end wall 342 and a sidewall 344 surrounding the end wall. End wall 342 and sidewall 344 form a socket 346 that can receive the base portion of a bottle, when top/bottom tray 300 is oriented in an upright position at the bottom of a stack. Alternatively, socket 346 can receive the neck portion N of a bottle when top/bottom tray is oriented in an inverted position and placed at the top of a stack. In FIG. 2, for example, the stack ST includes one top/bottom tray 300*a* oriented in an upright position, receiving the base portions of bottles B1. Stack ST also includes a top/bottom tray 300*b* oriented in an inverted position, receiving the neck portions of bottles B3. When referring to the orientation of top/bottom trays, the term "upright" means an orientation in which rim 342 is positioned vertically below sidewall 344, and the term "inverted" means an orientation in which the rim is positioned vertically above the sidewall with respect to vertical axis Y.

Sockets 346 are arranged adjacently or tangentially to one another, much like the sockets 246 in shoulder tray 200. This arrangement allows multiple bottles to be positioned adjacent to one another in a compact arrangement so as to reduce the overall size of top/bottom tray 300 and increase the number of bottles that can fit in a tray of a specific size. Sockets 346 located along the perimeter or exterior 302 of top/bottom tray 300 have sidewalls 344 with a continuous sidewall region 347. Each continuous sidewall region 347 surrounds at least half of the respective socket 346. Sockets 346 located toward the center or interior of top/bottom tray 300 have sidewalls 344 made up of four or more triangular posts or dividers 348. In preferred embodiments, like the one shown, the triangular dividers 348 each have a concave contour 349 on each side that conforms to the curvature of the bottles to be loaded into the tray. The sockets 346 are preferably dimensioned and arranged to allow a minimum clearance space between bottles so that the bottles can be loaded and unloaded without rubbing against adjacent bottles in the tray.

Figure 10:
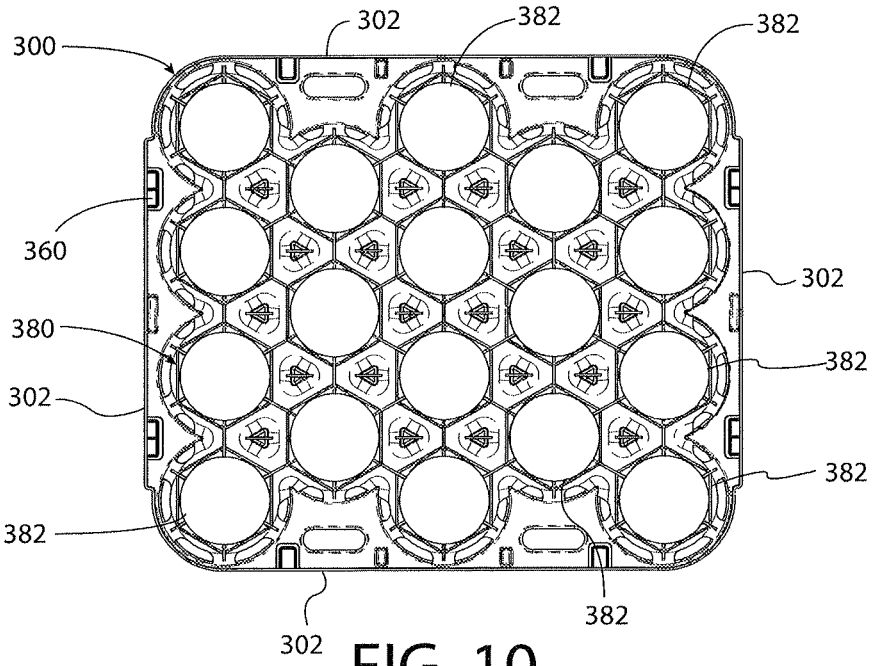
FIG. 10 is a bottom view of the second tray component of FIG. 9.
Figure 11:
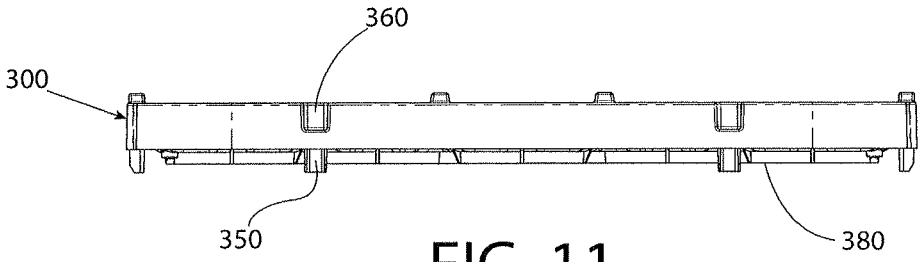
FIG. 11 is a front view of the second tray component of FIG. 9.
Figure 12:
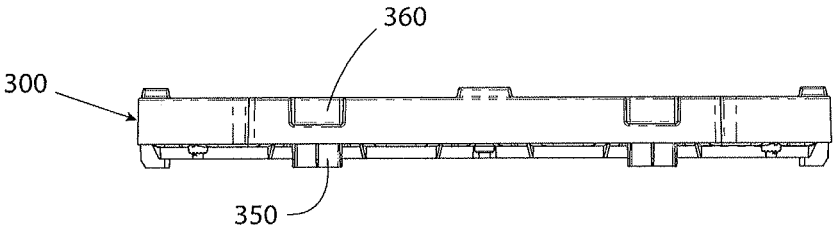
FIG. 12 is a side view of the second tray component of FIG. 9.
Figure 13:
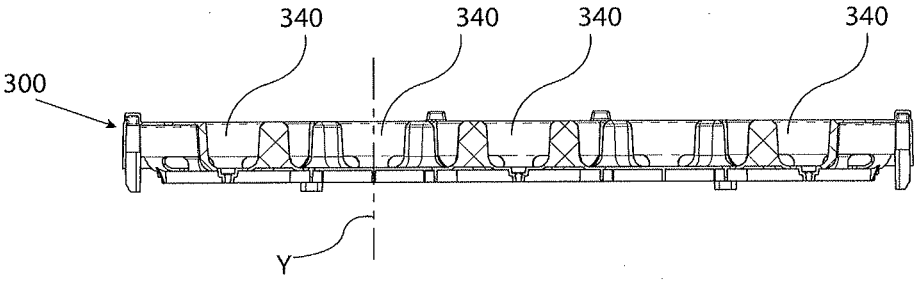
FIG. 13 is a cross-section view of the second tray component of FIG. 9, taken through line 13-13 in FIG. 9.
Figure 14:
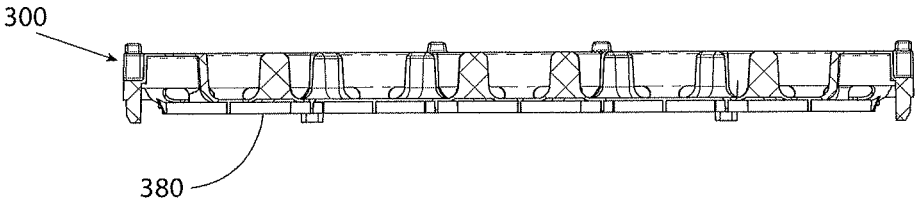
FIG. 14 is a cross-section view of the second tray component of FIG. 9, taken through line 14-14 in FIG. 9.

Referring to FIG. 10, the bottom of top/bottom tray 300 has a reinforcing rib structure 380 that includes a number of hexagonal shaped rings 382. Rib structure 380 is produced by injection molding, as noted above. When other manufacturing processes are used, like thermoforming, the top/bottom tray may not have a rib structure.

Referring again to FIGS. 1 and 2, tray system 100 further includes a pallet 400. Pallet 400 provides a rigid and stable foundation for stack ST. In addition, pallet 400 provides a mechanism for a forklift truck or other machinery to lift and move the stack ST. Pallet 400 has a generally rectangular shape featuring a top portion 410, a bottom portion 420 and four sidewalls 430 extending between the top and bottom portions. Each sidewall 430 forms two or more openings 432 adapted to receive a fork on a fork lift truck. A top/bottom tray may be permanently attached or anchored to the pallet. In FIG. 2, for example, top/bottom tray 300*a* is anchored to pallet 400 with anchor screws (not shown), forming a pallet-tray unit 450. Pallets and top/bottom trays in accordance with the invention may also be connected with detachable couplings, or not be connected at all.

Shoulder trays, top/bottom trays and pallets used in accordance with the invention may include one or more structures to assist in nesting the trays and pallets when the trays and pallets are empty. Referring to FIG. 2, each shoulder tray 200 includes a pair of tabs 250 extending from each side, and a pair of recesses 260 formed in each side. Similarly, each top/bottom tray 300 includes a pair of tabs 350 extending from each side, and a pair of recesses 360 formed in each side. Each recess 260 and 360 is wide enough and long enough to receive either a tab 250 or a tab 350 on another tray. Tabs 250, 350 and recesses 260, 360 allow the trays 200, 300 to nest with one another when the trays are empty. This allows empty trays 200 and 300 to be stored neatly and compactly in a truck, so that they can be transported and unloaded from the truck in a secure and efficient manner.

Tabs 350 on top/bottom trays 300 also assist in aligning and centering the top/bottom trays 300 onto pallets 400 prior to mounting the top/bottom trays to the pallets. In FIG. 2, pallet 400 includes slots 460. Tabs 350 on top/bottom tray 300*a* register with slots 460 only when the top/bottom tray is properly centered or positioned on top of the pallet. This ensures that top/bottom tray 300*a*, and the rest of the stack ST, is placed in a centered and stable manner on top of pallet 400.

Tray systems in accordance with the invention may include any number of stacking units, and thus any number and arrangement of bottles. The bottles can be stacked in two or more rows extending in a first direction, and two or more columns extending in a second direction perpendicular to the first direction. Tray system 100 includes seven rows $R_1$-$R_7$ and five columns $C_1$-$C_5$, as best seen in FIGS. 3 and 4. The rows and columns have alternating numbers of stacking units. That is, the rows alternate between having either two stacking units or three stacking units. The columns alternate between having either three stacking units or four stacking units. Those skilled in the art will appreciate that tray systems in accordance with the invention can have fewer or more stacking units in each row and each column, and need not have the arrangement shown in the drawings. In addition, the rows and columns may have a constant number of stacking units, and the columns may have a constant number of stacking units, resulting in a grid arrangement. For example, a tray system may feature rows containing four stacking units and columns containing three stacking units.

Trays and pallets in accordance with the invention may be manufactured to meet industry standard dimensions for different markets, and to accommodate different sized bottles. For example, tray systems in accordance with the invention may include components that are 40 in. by 48 in. for the U.S. market, or 1,000 mm by 1,200 mm for the European market. Those skilled in the art will understand that trays and pallets in accordance with the invention can have other dimensions to meet customer specifications, and/or to accommodate different bottle sizes.

The stacking units may be integrally attached to one another, as shown in FIGS. 1-8, so as to form a single homogenous tray of unitary construction. Alternatively, each stacking unit, or group of stacking units, may be molded as separate components that can be modularly connected to one another. For example, a strip of four integrally formed stacking units may be designed for modular connection to a strip of three integrally formed stacking units. Alternatively, a strip of four integrally formed stacking units may be designed for modular connection to another strip of four integrally formed stacking units. Trays and pallets in accordance with the invention are preferably manufactured with materials that offer extremely long product life. Unlike wood pallets and slip sheets, trays and pallets in accordance with the invention can be manufactured with durable warp-resistant materials that are reusable and recyclable.

Figure 15:
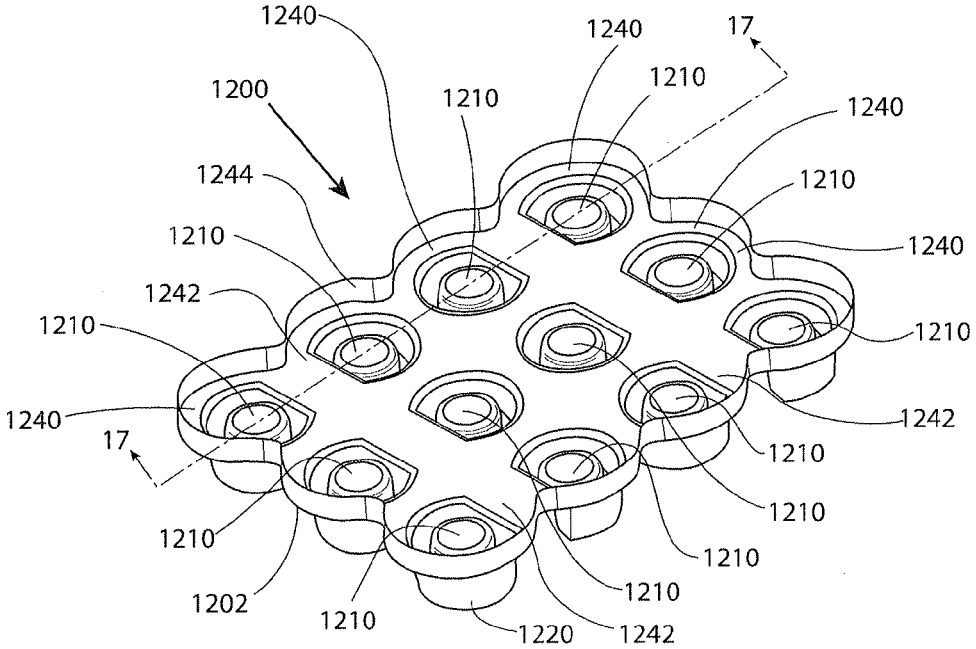
FIG. 15 is a top perspective view of a tray component for a tray system in accordance with another exemplary embodiment.
Figure 16:
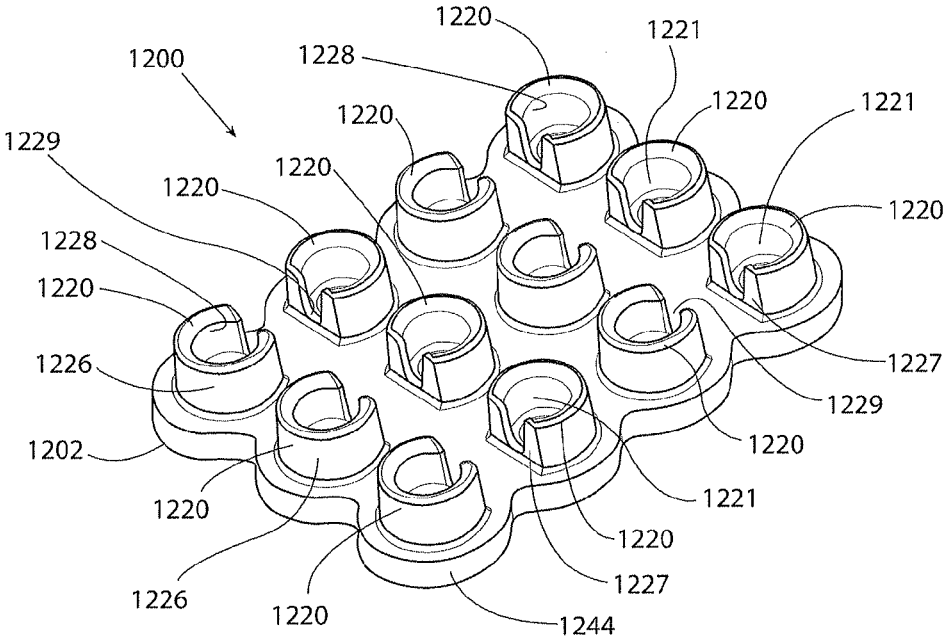
FIG. 16 is a bottom perspective view of the tray component of FIG. 15.
Figure 17:
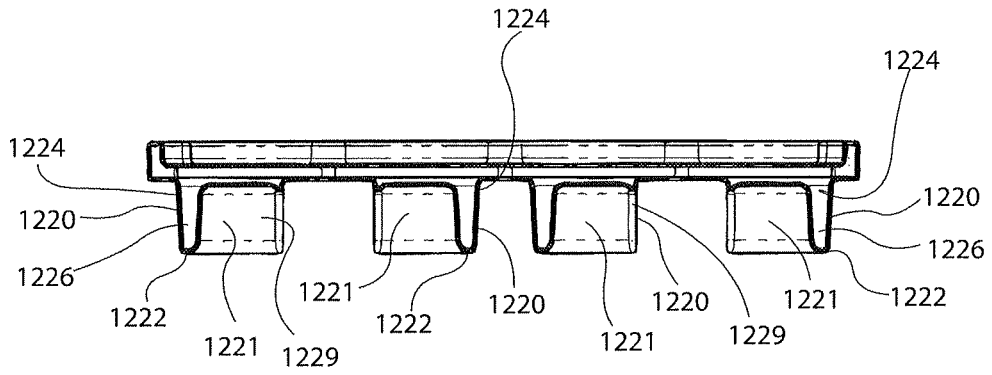
FIG. 17 is a cross-section view of the tray component of FIG. 15, taken through line 17-17 in FIG. 15.
Figure 18:
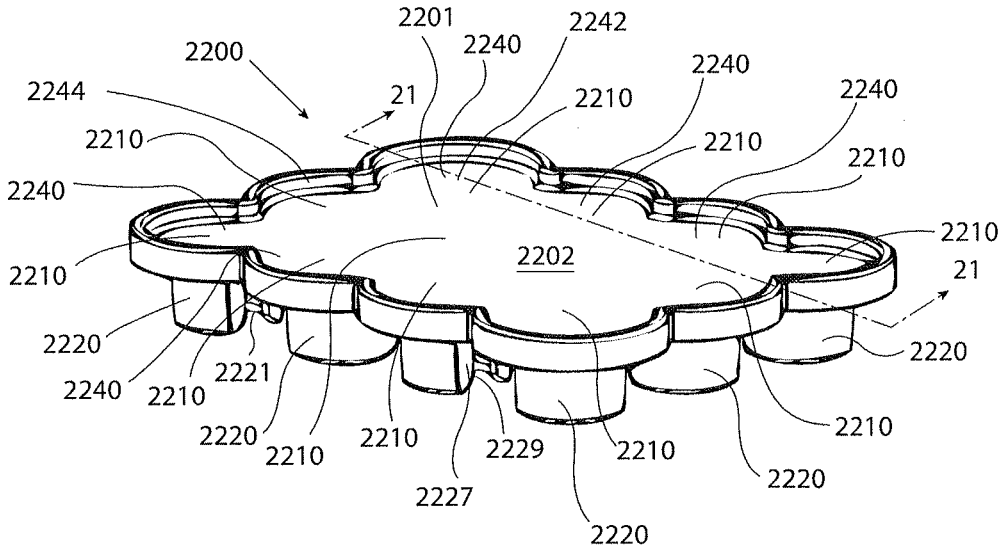
FIG. 18 is a top perspective view of a tray component for a tray system in accordance with another exemplary embodiment.
Figure 19:
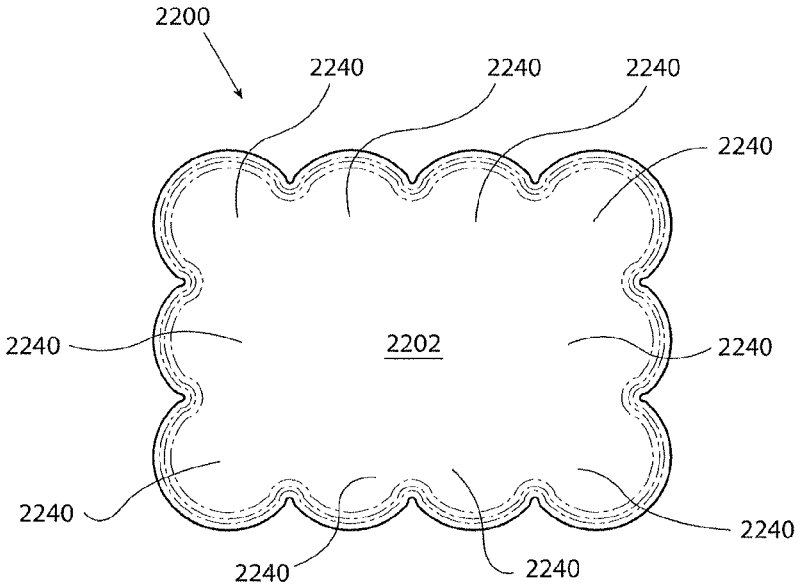
FIG. 19 is a top view of the tray component of FIG. 18.
Figure 20:
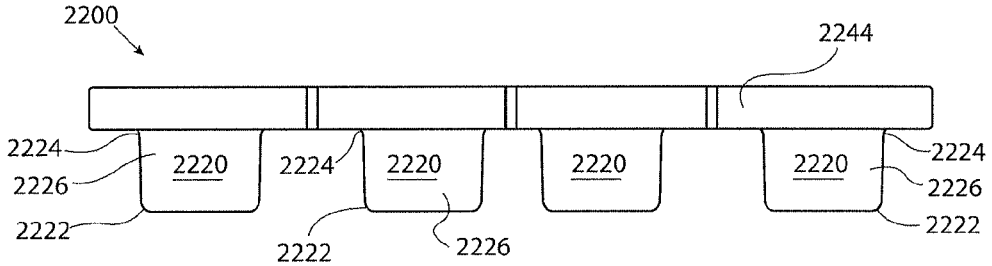
FIG. 20 is a side view of the tray component of FIG. 18.
Figure 21:
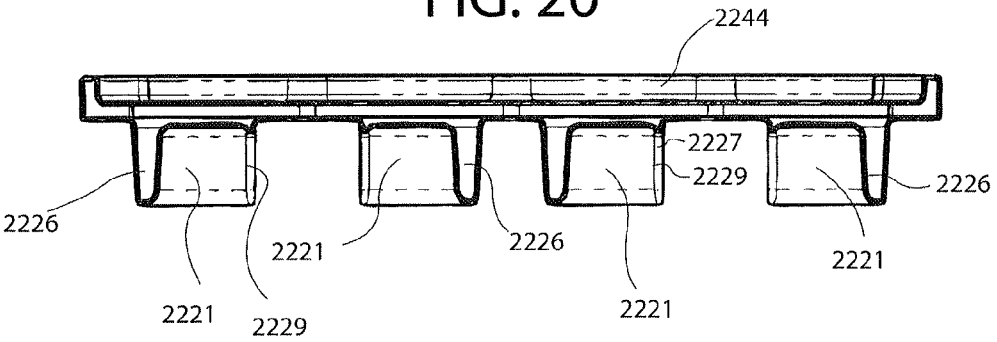
FIG. 21 is a cross-section view of the tray component of FIG. 18, taken through line 21-21 in FIG. 18.
Figure 22:
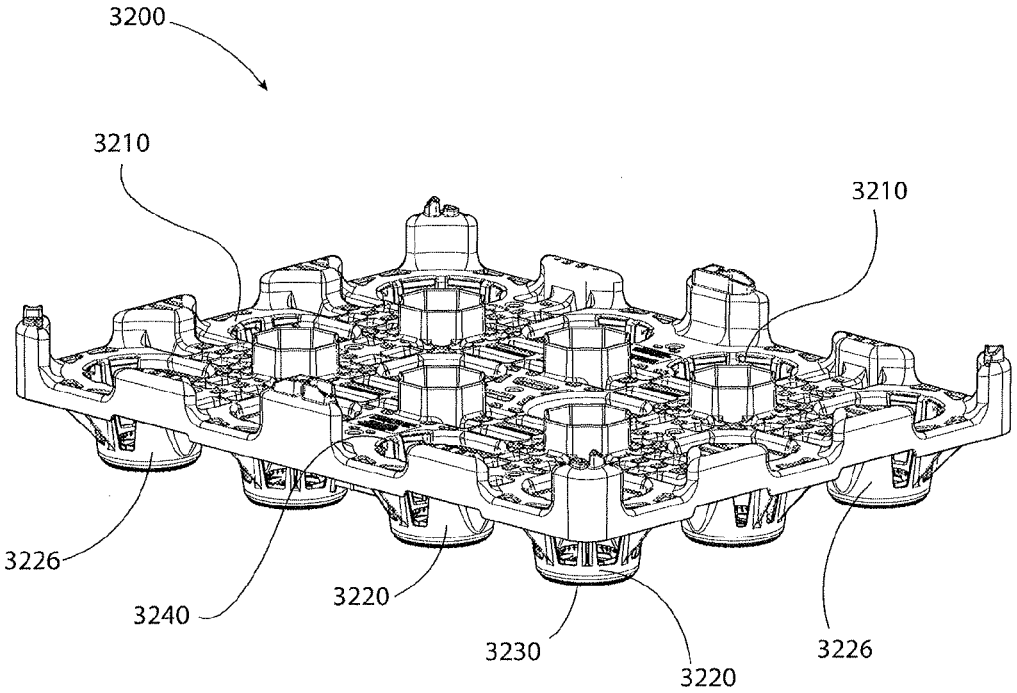
FIG. 22 is a perspective view of a tray in accordance with another exemplary embodiment.
Figure 23:
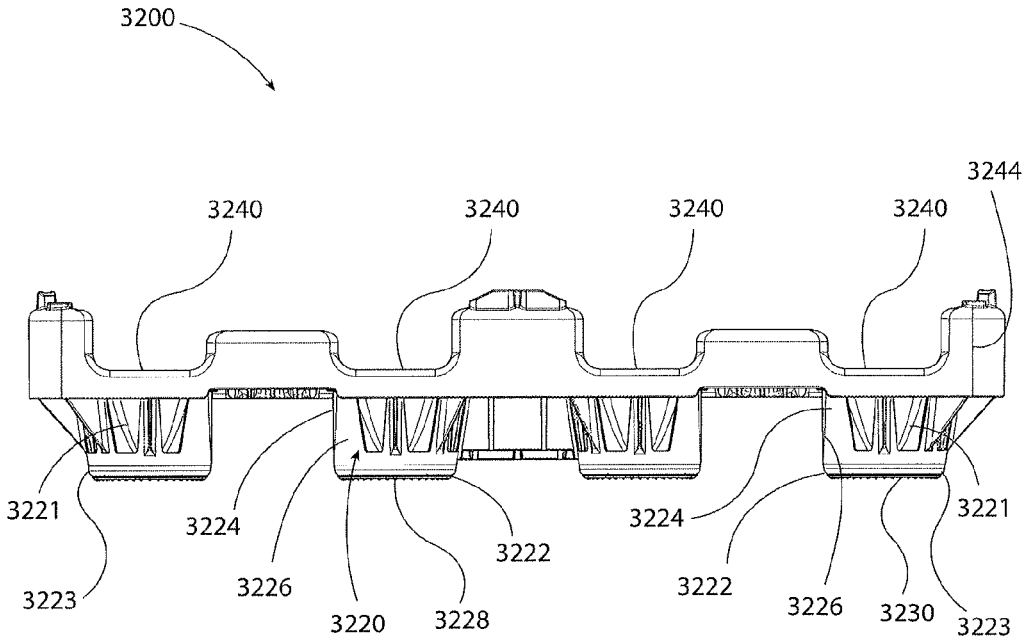
FIG. 23 is a front view of the tray of FIG. 22, the front view being identical to the rear view of the tray.
Figure 24:
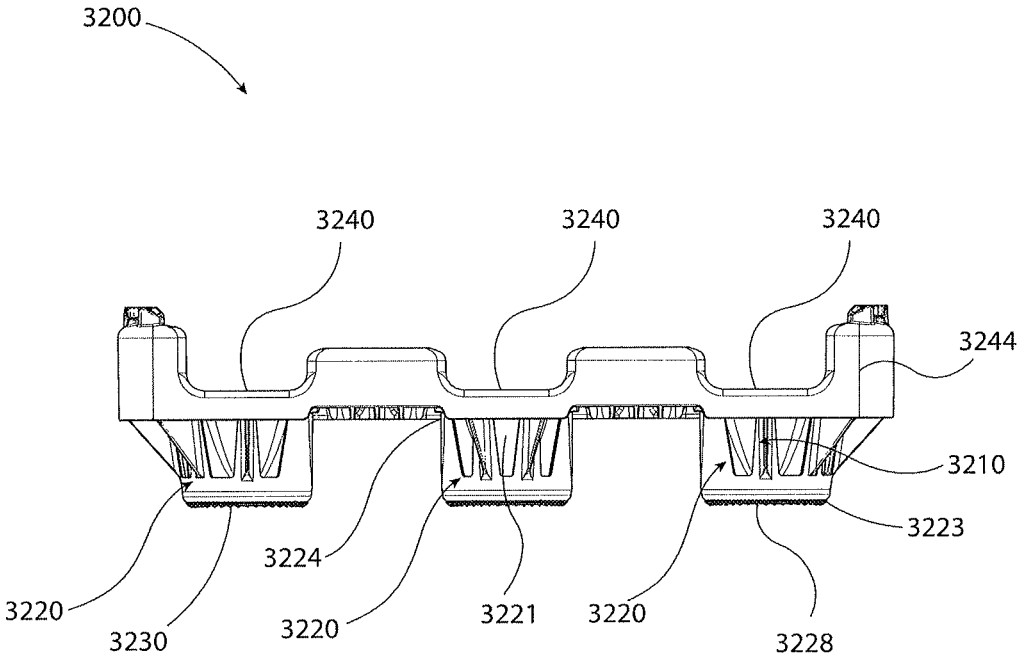
FIG. 24 is a left view of the tray of FIG. 22, the left view being identical to the right view of the tray.
Figure 25:
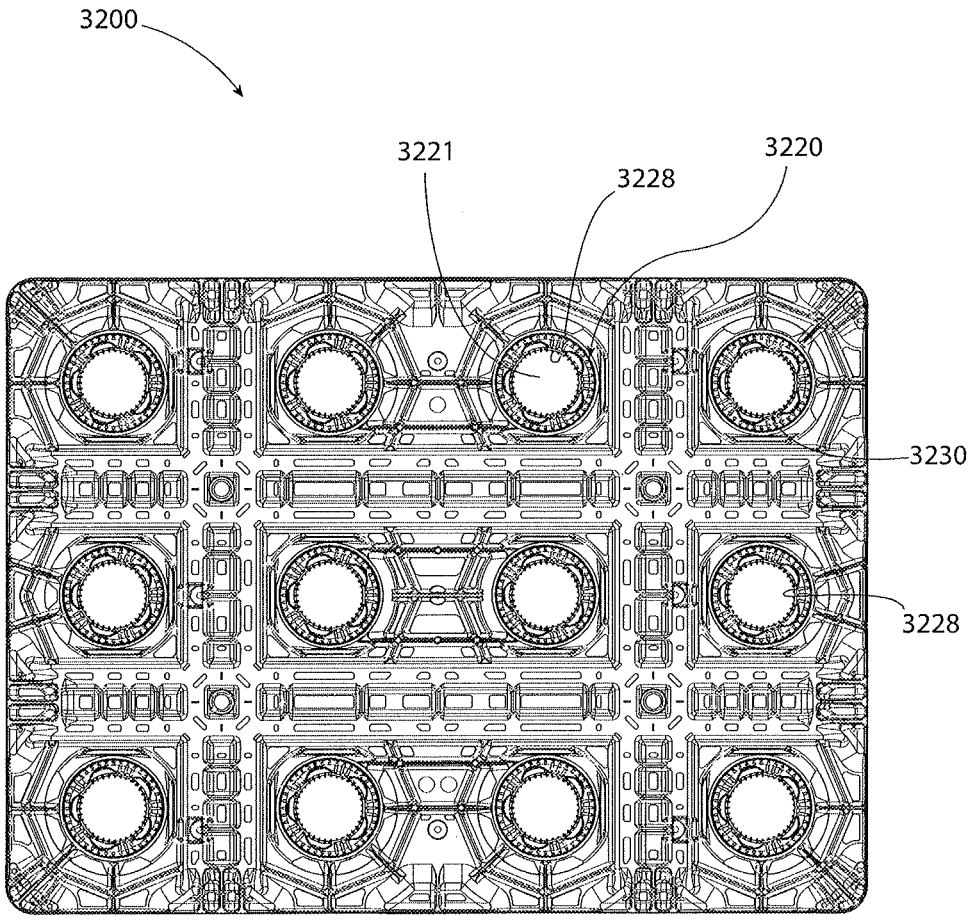
FIG. 25 is a bottom view of the tray of FIG. 22.
Figure 26:
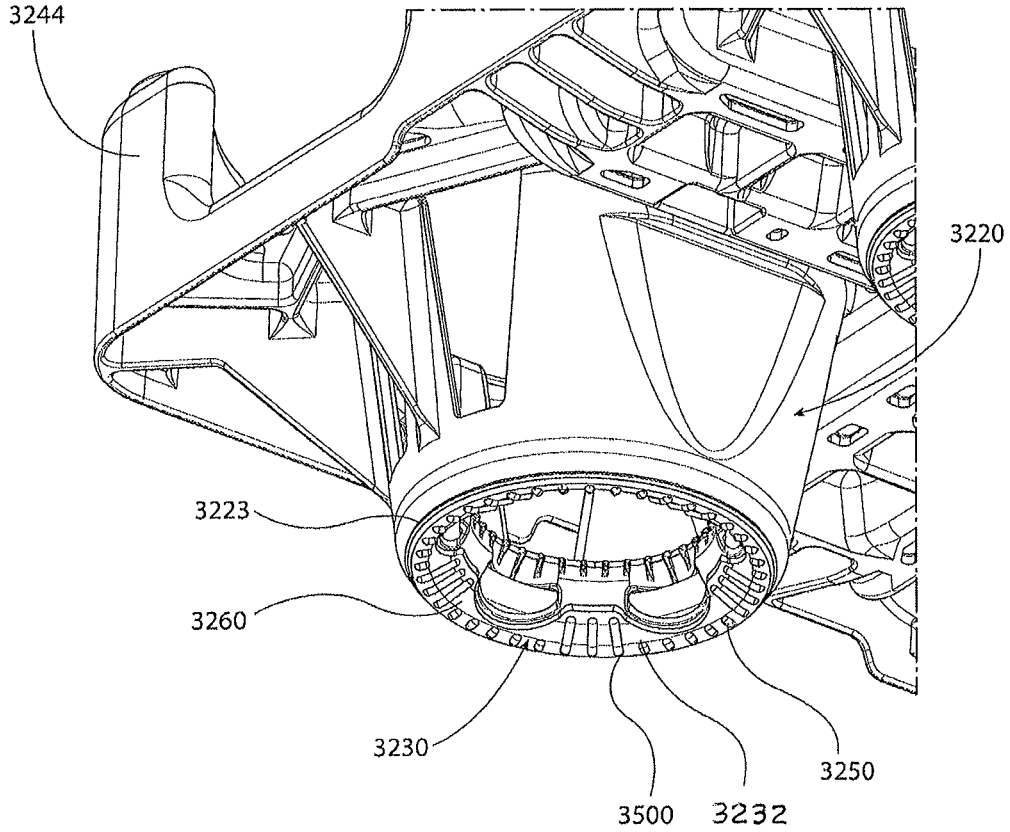
FIG. 26 is a bottom perspective view of one portion of the tray of FIG. 22.

Referring now to FIGS. 15-17, a shoulder tray 1200 is shown in accordance with another exemplary embodiment. Shoulder tray 1200 can be manufactured by a number of different processes, including but not limited to thermoforming, injection molding and compression molding. Shoulder tray 1200 is similar to shoulder tray 200 but features a plurality of stacking units 1210 that are aligned with one another in a grid arrangement. There are an equal number of stacking units 1210 in each row and in each column.

Each stacking unit 1210 forms a lower receptacle 1220 for receiving the neck portion of a first bottle and an upper receptacle 1240 for receiving a base portion of a second bottle stacked above the first bottle. Each upper receptacle 1240 has a bottom wall 1242. A sidewall 1244 extends around the perimeter or exterior 1202 of shoulder tray 1200, bordering the upper receptacles 1240 located along the perimeter of the shoulder tray. Unlike shoulder tray 200, the upper receptacles 1240 of shoulder tray 1200 do not have posts or dividers that separate the upper receptacles from one another. This provides bottles with greater freedom to slide on shoulder tray 1200.

Each lower receptacle 1220 includes a first end 1222, a second end 1224 opposite the first end, and a sidewall 1226 connecting the first end with the second end. First end 1222 and second end 1224 both have circular geometries. Sidewall 1226 surrounds an interior space 1221. First end 1222 forms an opening 1228 into interior space 1221 for receiving the neck of a bottle into lower receptacle 1220. Sidewall 1226 gradually tapers radially inwardly as the sidewall extends from first end 1222 to second end 1224.

Each sidewall 1226 forms a frustoconical-shaped enclosure adapted to partially surround and protect the neck portion of a bottle received in a lower receptacle 1220. Sidewalls 1226 have ring-like configurations that are interrupted by flattened sections 1227. Apertures 1229 are formed through flattened sections 1227, creating passages into interior spaces 1221. The flattened sections 1227 of lower receptacles 1220 face the same direction in each row, but each row alternates with respect to the direction in which the flattened sections face. As such, each flattened section 1227 of a lower receptacle faces a flattened section 1227 of another lower receptacle.

Referring to FIGS. 18-21, a shoulder tray 2200 is shown in accordance with another exemplary embodiment. Shoulder tray 2200 can be manufactured by a number of different processes, including but not limited to rotational molding, blow molding or twin sheet thermoforming. Shoulder tray 2200, like shoulder tray 1200, features a plurality of stacking units 2210 that are aligned with one another in a grid arrangement. There are an equal number of stacking units 2210 in each row and in each column.

Each stacking unit 2210 forms a lower receptacle 2220 for receiving the neck portion of a first bottle and an upper receptacle 2240 for receiving a base portion of a second bottle stacked above the first bottle. The top portion 2201 of shoulder tray 2200 includes a uniformly flat surface 2202. Each upper receptacle 2240 has a bottom wall 2242 that forms part of flat surface 2202. A sidewall 2244 extends around the perimeter or exterior 2202 of shoulder tray 2200, bordering the upper receptacles 2240 located along the perimeter of the shoulder tray. Upper receptacles 2240 of shoulder tray 2200 do not have posts or dividers that separate the upper receptacles from one another.

Each lower receptacle 2220 includes a first end 2222, a second end 2224 opposite the first end, and a sidewall 2226 connecting the first end with the second end. First end 2222 and second end 2224 both have circular geometries. Sidewall 2226 surrounds an interior space 2221. First end 2222 forms an opening 2228 into interior space 2221 for receiving the neck of a bottle into lower receptacle 2220. Sidewall 2226 gradually tapers radially inwardly as the sidewall extends from first end 2222 to second end 2224.

Each sidewall 2226 forms a frustoconical-shaped enclosure adapted to partially surround and protect the neck portion of a bottle received in a lower receptacle 2220. Sidewalls 2226 have ring-like configurations that are interrupted by flattened sections 2227. Apertures 2229 are formed through flattened sections 2227, creating passages into interior spaces 2221. The flattened sections 2227 of lower receptacles 2220 face the same direction in each row, but each row alternates with respect to the direction in which the flattened sections face. As such, each flattened section 2227 of a lower receptacle faces a flattened section 2227 of another lower receptacle.

When a shoulder tray is stacked above another shoulder tray containing bottles, the lower receptacles of the upper tray rest on the shoulders of bottles in the underlying tray and distribute loads to those bottles. When stacks of shoulder trays containing bottles are shipped in vehicles, the shoulder portions of bottles in underlying trays must not only support significant loads, but must also absorb substantial shock forces. Sudden stops, bumpy road conditions and other factors can subject delivery vehicles, and the trays within them, to frequent jarring and bouncing. Some jarring and bouncing can cause rims to briefly lift off the shoulders of bottles and land back on the bottles. Jarring and bouncing can also cause stacks to rock or shake, causing the rims to rub against bottle shoulders. Constant bouncing and rubbing between the rim and the bottle shoulders can scratch or mar the bottles. Over time, this can weaken the integrity of bottles and/or affect the appearance of bottles.

Protecting the shoulder portions of reusable bottles from wear, particularly in the HOD bottled water business, increases the useful life of bottles in two ways. First, protecting the shoulder portions preserves the structural integrity of bottles, which allows the bottles to be used longer. By protecting the shoulder portions, the reusable bottles sustain less stress over time, decreasing the development of cracks and other damage that can cause the bottles to fail and leak.

Second, protecting the shoulder portions preserves the aesthetics of the bottles, and reduces the number of customer complaints about the bottles. Many home and office water coolers have an opening at the top of the cooler to fill an internal reservoir. The reservoir is filled by removing the cap from a bottle, inverting the bottle over the opening of the cooler, and lowering the bottle neck into the opening to fill the reservoir. The opening at the top of the cooler receives the bottle neck and supports the bottle, with the shoulder area extending into the opening above the reservoir. Bottles with significant marring and scratching around the shoulder area give customers the impression that the bottle shoulders contain dirt and grime. Therefore, many customers who see scratches on bottle shoulders reject the bottles out of concern that dirt and grime will enter their water cooler. In many cases, a perfectly functional water bottle with structural integrity will be rejected by a customer due to surficial scratching, forcing the vendor to discard and replace the bottle.

To protect bottle shoulders against structural and aesthetic damage, shoulder trays in accordance with the invention can include cushions or other scratch prevention materials, as described previously in connection with FIG. 2. Cushions and scratch prevention materials can be incorporated on or in the lower receptacles to prevent the tray from scratching and marring the shoulder portions of underlying bottles. In addition, cushions and scratch prevention materials can dampen shock forces that are received by shoulder portions when jarring and bouncing occurs.

Cushions and scratch prevention materials in accordance with the invention can include static cushions that are fixed in position relative to the lower receptacle. A static cushion that is fixed inside or on the lower receptacle can reduce or prevent scratches and marring on the bottle shoulder.

As an alternative to fixed cushions, Applicants have found that movable cushions also protect bottles from wear. Cushions that are designed to rotate or "float" relative to the rim of the shoulder tray can dampen shock forces that travel through the shoulder tray during jarring and bouncing. This dampening effect reduces the amount of shock forces that travel to the shoulder portions of bottles. Floating cushions allow each bottle to rotate or spin independently within the stack in response to an impact force. At the same time, the floating cushions grip the surface of each bottle, so that there is little or no relative movement between the bottle and the floating cushion. In this arrangement, any rubbing that occurs will occur between the floating cushion and the lower receptacle of the tray, not between the tray and the bottle shoulder. The floating cushion and bottle preferably rotate in unison when rotation occurs. The floating cushion is preferably made of a soft resilient material, so that if there is a small amount of movement between the bottle and the floating cushion, the relative movement does not scratch or mar the bottle.

Referring now to FIGS. 22-30, a shoulder tray 3200 with a floating cushioning element is shown in accordance with another exemplary embodiment. Shoulder tray 3200 has many features that are identical or similar to previously described embodiments. Therefore, features that are identical or similar to features in previously described embodiments will not be described, with the understanding that corresponding or analogous features have the same description. Shoulder tray 3200 can be manufactured by a number of different processes, including but not limited to injection molding, rotational molding, blow molding or twin sheet thermoforming.

Shoulder tray 3200, like shoulder trays 1200 and 2200, features a plurality of stacking units 3210 that are aligned with one another in a grid arrangement. There are an equal number of stacking units 3210 in each row and in each column. Each stacking unit 3210 forms a lower receptacle 3220 for receiving the neck portion of a first bottle, and an upper receptacle 3240 for receiving a base portion of a second bottle stacked above the first bottle.

Each lower receptacle 3220 includes a first end 3222, a second end 3224 opposite the first end, and a sidewall 3226 connecting the first end with the second end. First end 3222 and second end 3224 both have circular geometries. Sidewall 3226 surrounds an interior space 3221. First end 3222 forms an opening 3228 into interior space 3221 for receiving the neck of a bottle into lower receptacle 3220. Each sidewall 3226 forms a generally cylindrical enclosure adapted to partially surround and protect the neck portion of a bottle. First end includes a generally circular rim 3223 that circumscribes opening 3228. Rim 3223 is configured to surround a neck portion of a bottle that is received in the lower receptacle 3220, and rest on a shoulder portion of the bottle.

Referring to FIGS. 26-30, rim 3223 includes a protective element 3230. Protective element 3230 serves three purposes. First, protective element 3230 serves as a floating cushion 3232 that protects the shoulders of bottles beneath the rim during transport. Second, protective element 3230 serves as a protective replacement guard 3250 that protects the inside of the lower receptacle to increase the useful life of the shoulder tray. Third, protective element 3230 serves as an adapter or fitting 3260 that allows the tray to be used with a wide variety of bottle shapes and sizes. Fitting 3260 has a geometry and curvature designed to conform to the geometry and curvature of a particular bottle shape and size. Fitting 3260 is interchangeable with other fittings that conform to different bottle shapes and sizes. The ability to switch out a fitting 3260 and replace it with another fitting of a different design allows shoulder tray 3200 to be more versatile and accommodate different product, as will be described in more detail.

Protective element 3230 includes a body portion 3270 that connects directly to a lower receptacle 3220. Body portions in accordance with the invention are preferably made a resilient flexible material. For example, body portion 3270 is a molded part made of polypropylene. Body portion 3270 is a ring shaped component having a first end 3272, a second end 3274, and a longitudinal axis 3275 extending between the first end and second end. The diameter of body portion 3270 is smallest at first end 3272 and gradually increases toward second end 3274. First end 3272 defines the terminal end of a first section 3276. First section 3276 is a generally cylindrical-shaped section having a generally uniform diameter. First section 3276 transitions to a second section 3278 having a bell shape that expands radially outwardly as it extends away from the first section. Second end 3274 defines the terminal end of second section 3278.

Figure 27:
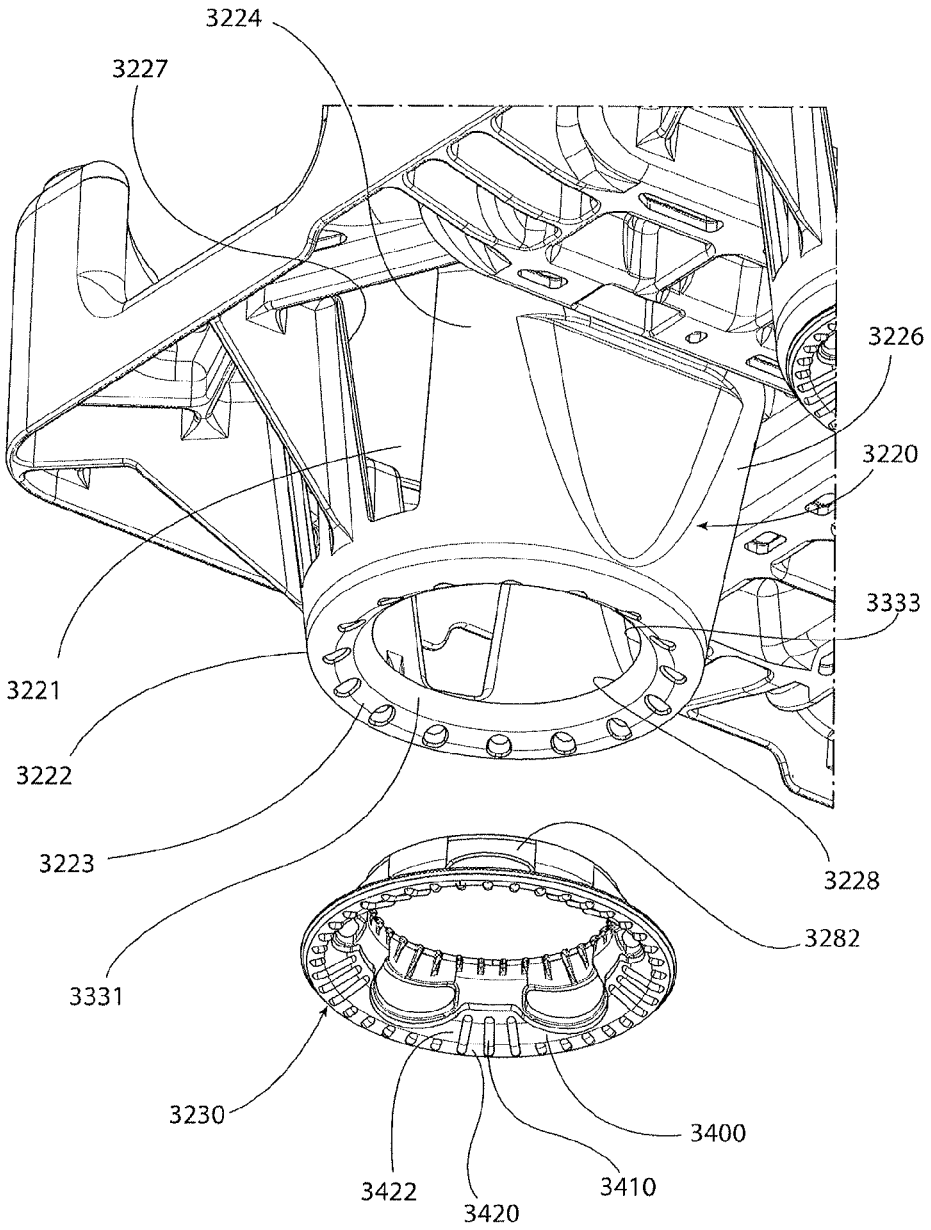
FIG. 27 is an exploded bottom perspective view of the portion of the tray shown in FIG. 26.
Figure 28:
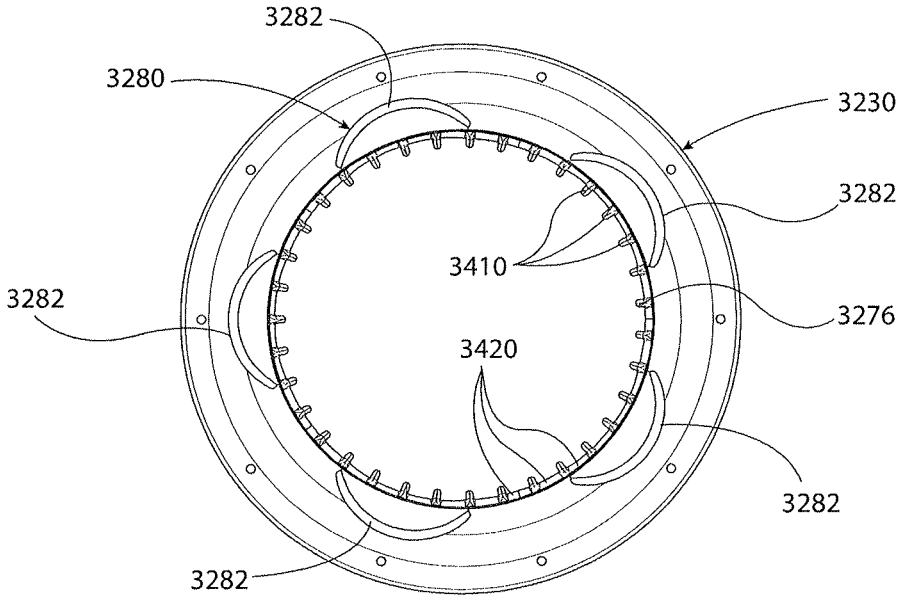
FIG. 28 is a top view of a detachable component of the tray of FIG. 22.
Figure 29:
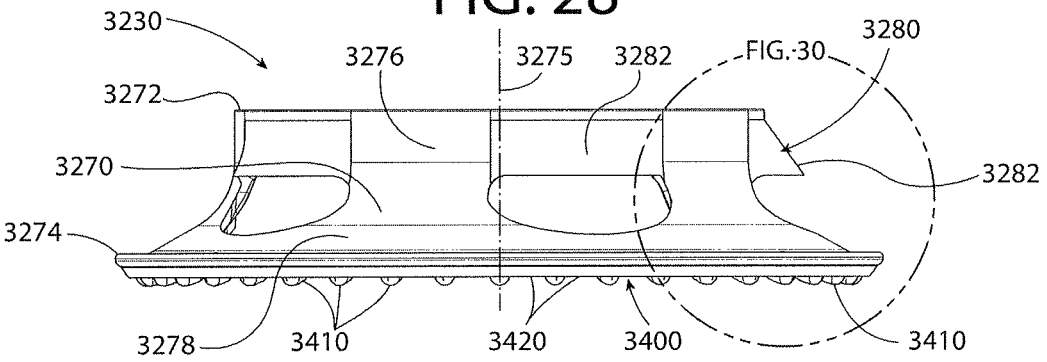
FIG. 29 is a side view of the component of FIG. 28.
Figure 30:
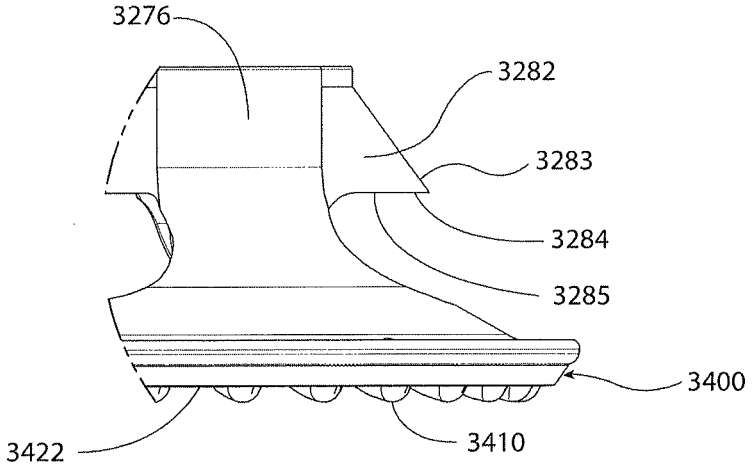
FIG. 30 is an enlarged side view of a portion of the component of FIG. 28.

First section 3276 includes a connecting element 3280 for attachment to the interior of a lower receptacle 3220 of shoulder tray 3200. Various configurations for connecting element 3280 can be employed. Referring to FIGS. 28-30, connecting element 3280 includes an array of arc-shaped projections 3282 uniformly arranged around the circumference of first section 3276. Arc-shaped projections 3282 are thin-walled structures configured to detachably couple protective element 3230 inside the interior of a lower receptacle 3220. In this regard, the first end 3222 of each lower receptacle 3220 forms a rounded bearing surface 3331 that extends inside the receptacle. Bearing surface 3331 gradually tapers radially inwardly as it extends from first end 3222 and toward second end 3224 of lower receptacle 3220. Bearing surface 3331 defines an interior ledge 3333, as shown best in FIG. 27, which surrounds opening 3228. The cross sectional area of protective element 3230 where the projections 3282 extend is greater than the cross sectional area of opening 3228. As such, the area around opening 3228 forms a constriction.

To detachably couple the protective element 3230 to a lower receptacle 3220, first end 3272 of body portion 3270 is inserted into first end 3222 of the lower receptacle. As protective element 3230 is inserted into lower receptacle 3220, projections 3282 contact bearing surface 3331. Bearing surface 3331 is relatively rigid as compared to the thin-walled projections 3282, the latter being more flexible. As a result, bearing surface 3331 bears against projections 3282 and compresses the projections radially inwardly as the protective element is inserted. Projections 3282 yield under the compressive force, which reduces the cross-sectional area of first section 3276 at the projections to allow the first section to pass through the constriction around opening 3228. As projections 3282 are compressed, the projections deform under stored energy. First section 3276 can be advanced through opening 3228 until projections 3282 pass through opening, at which time, the compressive forces on the projections are no longer present, and the stored energy in the projections is released. As stored energy in projections 3282 is released, the projections snap outwardly and return to their original arc-shape, at which time the cross sectional area of the projections is once again greater than the cross sectional area of opening 3228. The resilience of projections 3282 allow protective element 3230 to be inserted through each opening 3228 in a snap-fit arrangement, where the outward snapping of projections over ledge 3333 can be felt and heard with an audible snapping sound.

Each projection 3282 has a shape resembling a section of a cone. The conic section defines a barb-shaped profile 3283, which is seen best in FIG. 30. The barb-shaped profile 3283 forms a hook 3284 that cooperates with interior ledge 3333 to secure and retain protective element 3230 in the lower receptacle in a floating arrangement. Hook 3284 includes a smooth gliding surface 3285 that rests on ledge 3333 in a slidable engagement when first section 3276 is inserted in opening 3228. Second section 3278 rests against bearing surface 3331, which can also be a slidable engagement. In this arrangement, hooks 3284 abut the ledge 3333 to prevent protective element 3230 from reversing out of lower receptacle 3220, while bearing surface 3331 abuts second section 3278 to prevent protective element 3230 from advancing further into the lower receptacle. Axial movement of protective element 3230 is therefore restricted inside lower receptacle 3220. Protective element 3230 is free to rotate about axis 3275, however, because ledge 3333 and bearing surface 3331 do not restrict rotational displacement. With this freedom to rotate in the lower receptacle 3220, protective element 3230 provides a dynamic element that allows individual bottles to adjust and sustain less stress in response to sudden forces on the stack.

Vertically stacked shoulder trays can be subject to twisting forces caused by forces applied to trays in the upper levels of the stack. In this respect, a stack of shoulder trays is analogous to a deck of cards. A component of force acting on one side of the deck and applied to cards at the top of the deck will cause those cards to rotate relative to a vertical axis through the center of the cards. Cards further down in the deck will also rotate due to the weight of the cards above them, and due to the friction between the cards. Rotation of cards further down the deck can dissipate gradually, with cards further down the deck rotating less than cards above them, creating the appearance of twisting. The same twisting effect can be seen in a vertical stack of shoulder trays. Sideward forces on trays near the top of the stack can be transferred to trays further down in the stack. Without protective elements in accordance with the invention, twisting forces on a tray will be transferred to bottle shoulders beneath that tray. The bottle shoulders will bear the twisting load until the magnitude of twisting force overcomes the frictional resistance between the tray and the bottle. Once this occurs, the tray (or rim of the lower receptacle) will rotate on the bottle shoulder, causing rubbing which will scratch and wear down the bottle shoulder. When protective elements in accordance with the invention are used, no twisting force is transferred to the bottle because the protective element offers no resistance to the twisting force. This allows the tray to spin on top of the protective element, while the protective element remains stationary relative to the bottle. In this arrangement, the twisting tray only rubs against the protective element. No surface rubs against the bottle shoulder beneath the twisting tray.

To further protect bottles against wear, protective element 3230 includes a cushion element 3400 attached to body portion 3270. Cushion element 3400 has a ring shaped cushion body that attaches to the inside of the first and second sections 3276 and 3278 of body portion 3270. Cushion elements in accordance with the invention are preferably formed of thermoplastic elastomers, such as thermoplastic vulcanizates manufactured under the trademark Santoprene™. Cushion elements in accordance with the invention can be attached to the body portion using various techniques. For example, body portion 3270 is overmolded with cushion element 3400.

Body portion 3270 and cushion element 3400 collectively provide a protective guard or barrier 3500 between the shoulder tray and each bottle stacked beneath the shoulder tray. Protective barrier 3500 protects both the shoulder tray, and bottles stacked beneath the shoulder tray. In particular, body portion 3270 slides along each lower receptacle 3220 and protects the associated bearing surface 3331, interior ledge 3333, and other surfaces in the lower receptacle that can come into contact with bottles. At the same time, cushion element 3400 distributes weight to the bottle shoulders but does not scratch or mar the bottle shoulders due to the softness of the cushion material. In addition, the soft material absorbs some of the shock forces before the forces reach the bottle.

In preferred embodiments, the amount of surface area on the cushion element that contacts a bottle shoulder is limited. The protection element may therefore include one or more protuberances that contact some, but not all, of the bottle shoulder. For example, cushion element 3400 includes a plurality of ribs 3410 spaced uniformly around the cushion element. Ribs 3410 are separated from one another by channels 3420 defined between the ribs. Each rib 3410 projects radially inwardly from the rest of cushion element 3400. In this arrangement, the innermost portions of the ribs 3410 are the only portions of cushion element 3400 that contact a bottle shoulder. Surfaces 3422 that extend between ribs 3400, i.e. the surfaces that border each channel 3420, do not contact the bottle. This arrangement reduces the amount of surface area on cushion element 3400 that contacts a bottle. Channels 3420 also allow dirt or debris that enters the lower receptacle 3220 to drop through the channels, so that the dirt and debris does not get lodged between the cushion element and bottle where it can scratch or mar the bottle surface. Cushion elements in accordance with the invention can be manufactured with various other surface configurations to engage and protect the surface of bottles, with ribs representing only one possible configuration.

Protective elements in accordance with the invention can be detachably coupled to the lower receptacles of trays, so that protective elements can be removed from a shoulder tray for cleaning, maintenance, replacement or other purposes, as will be described. Lower receptacles in accordance with the invention can include one or more apertures or other openings for the purpose of removing protective elements. The apertures can be positioned to provide access into the interior of the lower receptacle where the connecting element secures the protective element to the lower receptacle. For example, sidewall 3226 of lower receptacle 3220 defines a side aperture 3227, as shown in FIG. 27. Side aperture 3227 provides access into the interior of lower receptacle 3220 in the area where projections 3282 abut ledge 3333. To remove a protective element 3230 from a lower receptacle 3220, one or more tools can be passed through the side aperture 3227, or through multiple side apertures. Once inserted, the tool(s) are pressed against one or more projections 3282 to deform the projections radially inwardly. In the deformed state, the projections 3282 can pass through opening 3228 and past ledge 3333 to allow the protective element to be reversed out of the lower receptacle.

The detachable coupling arrangement allows protective elements to be easily removed from shoulder trays when circumstances require the protective elements to be removed. These circumstances include situations where the protective element is worn and requires replacement with another protective element. In this capacity, the protective element is an inexpensive replacement part that receives most of the wear, while the lower receptacle of the tray is protected. This provides an economical way to maintain and increase the service life of a shoulder tray, which carries a much larger replacement cost than the protective element.

The detachable coupling arrangement also allows protective elements to be removed where the tray must be adapted to receive a new or different bottle shape or size. Shoulder trays in accordance with the invention are preferably designed to accommodate a large range of bottle shapes and sizes. Nevertheless, some customers who purchase trays may have a unique bottle shape or size that is not accommodated by a tray. A manufacturer of bottle trays can address the problem by designing a new mold and produce a tray that accommodates the customer's unique bottle. The expense of designing a new mold to make a new tray is very high, however. Such a solution is usually not feasible, particularly where a customer only requires a small number of trays. The substantial cost in designing and manufacturing new trays is avoided by using protective elements in accordance with the invention. Instead of designing a new tray to accommodate a bottle design, the lower receptacle of an existing tray is adapted to accommodate a new bottle design. Body portions and cushion elements in accordance with the invention are preferably available with multiple different shapes and contours to accommodate different bottle sizes and shapes. By using multiple different protective elements with a shoulder tray, the user can handle the shipment of multiple different bottle shapes and sizes with a single tray. The shape and contour of each protective element can be suited for a specific bottle shape and size, or a range of bottle shapes and sizes.

If desired, protective elements in accordance with the invention can be designed with unique attributes, indicia or labeling that indicates the type of bottle that the protective element accommodates. For example, protective elements can be color coded or provided with a specific label that identifies the type of bottle for which the protective element is designed. In this capacity, each protective element 3230 can serve as a customized fitting 3260 that adapts the internal geometry of a lower receptacle 3220 to a specific bottle design and shape, so that the bottles are securely retained in the lower receptacles. Customers who purchase shoulder trays with interchangeable protective elements can purchase different protective elements when they change bottle designs or add a new bottle design to their product line. This allows users of shoulder trays to keep reusing the trays even when their bottle design changes.

As noted earlier, trays and pallets in accordance with the invention are designed for the public display of water bottles, including store displays. Therefore, it should be understood that many elements in the illustrated embodiments are primarily or exclusively ornamental, for display purposes. The ornamental elements may have a wide variety of shapes or configurations selected to meet aesthetic criteria. The appearance of these elements may be chosen to achieve a specific visual effect for the product display. As such, the overall ornamental appearance of the trays and pallets as a whole, and individual elements thereof, may be modified in an infinite number of ways within the scope of the invention to suit particular tastes. To the extent that these elements also perform function, the elements can incorporate an infinite number of ornamental features and still perform the same function.

For example, the shape, contours, and relative dimensions of the shoulder trays need not match the exact shape, contours, and relative dimensions of shoulder trays 200, 1200, 2200 and 3200. Referring to shoulder tray 200, the tray has a uniform height with straight sides and rounded corners to provide a sleek appearance on its exterior that is symmetrical, smooth and streamlined. The exterior of shoulder tray 200 resembles a band that wraps around the stack of bottles, providing a neat and organized look. Trays 1200 and 2200 have undulating sides, as opposed to straight sides, creating a scalloped look around the perimeter. Tray 3200 has a perimeter sidewall 3244 with a non-uniform height. In particular, sidewall 3244 has a reduced height adjacent to each upper receptacle 3240, forming a thinner profile to make more of each bottle visible in the tray. These ornamental designs are in sharp contrast to a conventional pallet.

Shoulder trays in accordance with the invention may include various profiles and adornments. Instead of having a flat top surface along the outer perimeter, like the flat top edge 211 shown in FIGS. 5 and 6, shoulder trays in accordance with the invention may have a top edge that follows a sinusoidal wave. Ornamental aspects of the trays and pallets, like the exterior profile of the shoulder tray, can be selected to create a certain display theme or satisfy other aesthetic considerations, without influencing the function of the trays and pallets.

While preferred embodiments of the invention have been shown and described herein, it will be understood that such embodiments are provided by way of example only. Numerous variations, changes and substitutions will occur to those skilled in the art without departing from the scope of the invention. Accordingly, it is intended that the appended claims cover all such variations.

What is claimed:

1. A tray system for display, storage and transportation of bottles, the tray system comprising a first tray having a plurality of stacking units, each stacking unit comprising a lower receptacle for receiving a neck portion of a first bottle, each stacking unit further comprising an upper receptacle for receiving a base portion of a second bottle to be stacked vertically above a first bottle, the lower receptacle comprising a first end, a second end opposite the first end, and a sidewall connecting the first end with the second end, the first end forming an opening for receiving the neck portion of the first bottle into the lower receptacle, the lower receptacle further comprising a protective element, the protective element attached to the lower receptacle to provide a protective guard between the lower receptacle and a shoulder portion of the first bottle received in the lower receptacle, wherein the protective element is rotatably coupled to the lower receptacle to provide a dynamic element that rotates relative to the lower receptacle in unison with the first bottle received in the lower receptacle.

2. The tray system of claim 1, wherein the first end of the lower receptacle comprises a rim that surrounds at least a portion of the opening, the rim configured to surround at least a portion of the neck portion of the first bottle received in the lower receptacle, the rim further configured to rest on top of the shoulder portion of the first bottle received in the lower receptacle to distribute load onto the shoulder portion of the first bottle received in the lower receptacle.

3. The tray system of claim 2, wherein the protective element is coupled to the rim and configured to rest directly on the shoulder portion of the first bottle received in the lower receptacle, the protective element thereby being in between the rim and the shoulder portion.

4. The tray system of claim 1, wherein the protective element comprises a cushion element.

5. The tray system of claim 4, wherein the cushion comprises a layer of elastomeric material.

6. The tray system of claim 1, wherein the protective element is detachably coupled to the lower receptacle.

7. The tray system of claim 6, wherein the tray system comprises an alternate protective element, the alternate protective element being interchangeable with the protective element to replace the protective element in the lower receptacle.

8. The tray system of claim 7, wherein the protective element comprises a first fitting having a geometry that conforms to a shape and size of a first bottle configuration, and the alternate protective element comprises a second fitting having a geometry that conforms to a shape and size of a second bottle configuration having a different shape and size than said first bottle configuration.

9. The tray system of claim 1, wherein the protective element comprises a body portion and a cushion element attached to the body portion.

10. The tray system of claim 9, wherein the body portion comprises a first section detachably coupled to the lower receptacle and a second section.

11. The tray system of claim 10, wherein the first section comprises a connecting element for attachment to an interior portion of the lower receptacle.

12. The tray system of claim 11, wherein the connecting element comprises a plurality of flexible projections arranged around the perimeter of the first section.

13. The tray system of claim 12, wherein the interior portion of the lower receptacle comprises an interior ledge that abuts the plurality of flexible projections to prevent the protective element from reversing out of the lower receptacle.

14. The tray system of claim 10, wherein the lower receptacle comprises a bearing surface that abuts the second section of the body portion.

15. The tray system of claim 1, wherein the protective element is rotatably coupled to the lower receptacle to provide a dynamic element that rotates or spins in unison with the first bottle received in the lower receptacle.

16. The tray system of claim 15, wherein the protective element comprises a floating cushion in the lower receptacle.

17. The tray system of claim 1, wherein the protective element comprises one or more extensions that contact the first bottle received in the lower receptacle to limit an amount of surface area on the protective element that contacts the first bottle.

18. The tray system of claim 17, wherein the one or more extensions comprises a plurality of ribs spaced around the protective element.

19. The tray system of claim 1, wherein the protective element comprises a first section that is generally cylindrical and a second section that comprises a bell shape.

20. The tray system of claim 1, further comprising a second tray configured identically to the first tray and stackable above or below the first tray.

21. A tray for display, storage and transportation of bottles, the tray comprising a plurality of stacking units, each stacking unit comprising a lower receptacle for receiving a neck portion of a first bottle, each stacking unit further comprising an upper receptacle for receiving a base portion of a second bottle to be stacked vertically above a first bottle, the lower receptacle comprising a first end, a second end opposite the first end, and a sidewall connecting the first end with the second end, the first end forming an opening for receiving the neck portion of the first bottle into the lower receptacle, the lower receptacle further comprising a protective element, the protective element attached to the lower receptacle to provide a protective guard between the lower receptacle and a shoulder portion of the first bottle received in the lower receptacle, wherein the protective element is rotatably coupled to the lower receptacle to provide a dynamic element that rotates relative to the lower receptacle in unison with the first bottle received in the lower receptacle.

* * * * *